US006916090B2

(12) United States Patent
Valley et al.

(10) Patent No.: US 6,916,090 B2
(45) Date of Patent: Jul. 12, 2005

(54) INTEGRATED FLUID EJECTION DEVICE AND FILTER

(75) Inventors: Jeffrey M. Valley, Corvallis, OR (US); Jeffery S. Hess, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 29 days.

(21) Appl. No.: 10/386,284

(22) Filed: Mar. 10, 2003

(65) Prior Publication Data

US 2004/0179073 A1 Sep. 16, 2004

(51) Int. Cl.[7] ..... B41J 2/19
(52) U.S. Cl. ..... 347/93
(58) Field of Search ..... 347/49, 65, 87, 347/92, 93

(56) References Cited

U.S. PATENT DOCUMENTS

| | | | | | |
|---|---|---|---|---|---|
| 4,639,748 | A | | 1/1987 | Drake et al. | |
| 4,771,295 | A | * | 9/1988 | Baker et al. | 347/87 |
| 5,155,502 | A | * | 10/1992 | Kimura et al. | 347/87 |
| 5,204,690 | A | * | 4/1993 | Lorenze et al. | 347/93 |
| 5,308,442 | A | | 5/1994 | Taub et al. | |
| 5,387,314 | A | | 2/1995 | Baughman et al. | |
| 5,669,040 | A | | 9/1997 | Hisatake | |
| 5,716,533 | A | | 2/1998 | O'Neill et al. | |
| 5,738,799 | A | * | 4/1998 | Hawkins et al. | 216/27 |
| 6,000,787 | A | * | 12/1999 | Weber et al. | 347/65 |
| 6,019,457 | A | * | 2/2000 | Silverbrook | 347/65 |
| 6,120,139 | A | * | 9/2000 | Childers et al. | 347/92 |
| 6,162,589 | A | | 12/2000 | Chen et al. | |
| 6,194,109 | B1 | | 2/2001 | Lawton | |
| 6,251,567 | B1 | | 6/2001 | Reinecke et al. | |
| 6,260,957 | B1 | | 7/2001 | Corley, Jr. et al. | |
| 6,261,742 | B1 | | 7/2001 | Chen et al. | |
| 6,264,309 | B1 | | 7/2001 | Sullivan | |
| 6,303,274 | B1 | | 10/2001 | Chen et al. | |
| 6,305,790 | B1 | | 10/2001 | Kawamura et al. | |
| 6,309,054 | B1 | | 10/2001 | Kawamura et al. | |
| 6,347,861 | B1 | | 2/2002 | Tom et al. | |
| 6,360,439 | B1 | | 3/2002 | Cleland et al. | |
| 6,365,058 | B1 | | 4/2002 | Beatty et al. | |
| 6,394,579 | B1 | | 5/2002 | Boyd et al. | |
| 6,431,686 | B2 | | 8/2002 | Saul et al. | |
| 6,454,393 | B2 | | 9/2002 | Chen et al. | |

* cited by examiner

*Primary Examiner*—Lamson Nguyen
*Assistant Examiner*—Blaise Mouttet

(57) ABSTRACT

An integrated fluid ejection device includes a fluid ejection element; a fluid filter; and a feed trench between the filter and the fluid ejection element. The fluid ejection element, fluid filter, and feed trench are formed from a single substrate.

24 Claims, 18 Drawing Sheets

INTEGRATED FLUID EJECTION DEVICE AND FILTER

A fluid ejection device can serve as an inkjet printing device. An inkjet printing device includes a print cartridge. Generally, an inkjet print cartridge includes, but is not limited to, a printhead and an ink reservoir. The ink reservoir fluidly couples to the printhead. The printhead manages a flow of fluid ink from the reservoir and disperses or ejects ink droplets toward and onto media to produce a printed image thereon. Inkjet printing devices can take the form of a conventional desk top printing device, e.g., such as often used for home or office printing applications and as coupled to a personal computer or one or more computing devices on a computer network. Inkjet printing devices may be provided in other contemplated forms, such as substantially smaller device-embedded forms including, but not limited to, devices used in cameras and portable computing devices.

Reduced size and weight can be advantageous for device-embedded inkjet printing devices, e.g., employing micro-printhead devices, such as those contemplated for integration into cameras and portable computing devices. A print cartridge design reducing the volume of the printhead allows a smaller overall device or allows a larger ink reservoir for a given size of device.

As inkjet printing technology evolves, higher resolution printing applications demand higher resolution inkjet print cartridges. Higher resolution printing applications, especially with miniaturized print cartridges, call for smaller ink-ejecting orifices and ink conducting channels within the print cartridge. Ink feed channels can be as small as 20 to 30 microns, small enough to be clogged by a variety of contaminants potentially introduced into an ink supply during cartridge manufacture. Clogged ink feed channels undesirably and adversely reduce image quality of the printed images.

For these and other reasons, there is a need for the present invention.

SUMMARY OF THE INVENTION

An integrated fluid ejection device includes a fluid ejection element; a fluid filter; and a feed trench between the filter and the fluid ejection element. The fluid ejection element, fluid filter, and feed trench are formed from a single substrate.

The organization and method of operation of embodiments of the invention, together with further advantages and objects thereof, may best be understood by reference to the following description taken with the accompanying drawings wherein like reference characters refer to like elements.

BRIEF DESCRIPTION OF THE DRAWINGS

For a better understanding of embodiments of the present invention, and to show how the same may be carried into effect, reference will now be made, by way of example, to the accompanying drawings in which.

DETAILED DESCRIPTION OF THE PREFERRED EMBODIMENT

Embodiments of the present invention as described and illustrated herein provide a fluid ejection device with an integrated fluid filter which enables reduced cost, simplified installation, and reduced opportunity for contaminates reaching the fluid channel.

Figure 1:
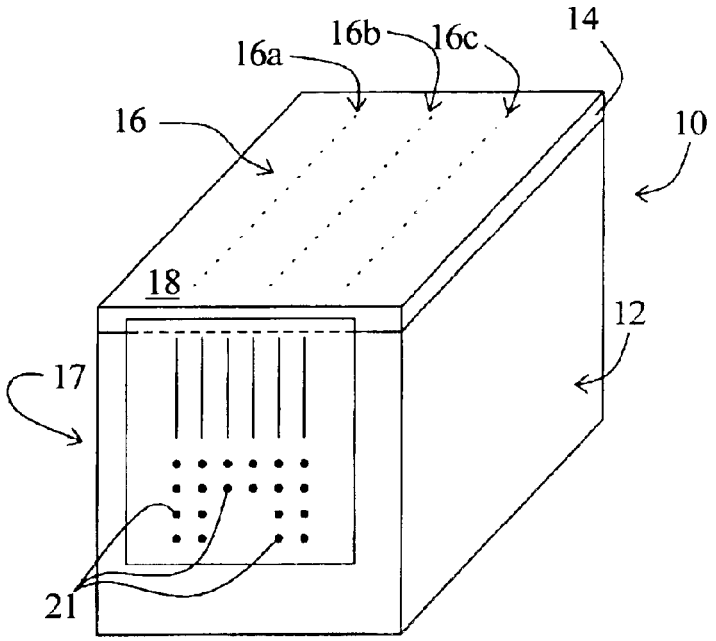
FIG. 1 illustrates in perspective a print cartridge according to an embodiment of the present invention.

FIG. 1 illustrates in perspective and schematically an inkjet print cartridge 10 according to an embodiment of the present invention. While illustrated in relation to an inkjet print cartridge ejecting ink droplets, it will be understood that reference herein to "ink" shall also include reference generally to fluids. For example, fluids dispensed by and in the fashion of a printhead including, but not limited to, various coating materials and media treatment materials as well as any fluid dispensed in controlled fashion by a print cartridge. In FIG. 1, cartridge 10 includes two basic components, an ink or fluid reservoir 12 and a printhead 14. As may be appreciated, reservoir 12 fluidly couples to printhead 14 and supplies, in the particular embodiment illustrated herein, ink thereto during printing operations. Printhead 14 includes an array of orifices 16 distributed at its outward-facing or media-facing surface 18. While illustrated herein schematically, it will be understood that orifices 16 may come in a variety of numbers and a variety of patterns. Control circuitry (not shown) coupled to printhead 14 controllably ejects ink droplets from, selected orifices 16 in producing print imaging upon media adjacent thereto.

As illustrated in FIG. 1, electrical conductors, or TAB elements, can be incorporated into cartridge 10 to couple circuit components within printhead 14 with such control circuitry. For example, a TAB circuit or ribbon cable 17 provides a set of exposed contacts 21 electrically coupled to ink ejecting elements, e.g., resistive elements, piezoelectric actuators and electrostatic actuators within printhead 14. Control circuitry coupled to contacts 21 thereby drives or "fires" ink-ejecting elements of printhead 14. As described more fully hereafter, printhead 14 together with TAB circuit 17 forms a TAB-head assembly making more efficient assembly of a cartridge 10 as provided under embodiments of the present invention.

A printing operation includes presentation of surface 18 to media while printhead 14 controllably ejects ink droplets from orifices 16. In many applications, cartridge 10 scans, i.e., reciprocates laterally, while media incrementally advances longitudinally, e.g., along a media feed path, in coordinated fashion to produce print imaging on the media. In other cases, however, cartridge 10 remains stationary while media moves therepast. Relative movement between cartridge 10 and media and concurrent controlled ejection of ink droplets from orifices 16 produces desired print imaging on media according to a given print job.

In the particular embodiment illustrated herein, cartridge 10 is a color inkjet cartridge including, as described more fully hereafter, three separate ink formulations, e.g., colors, and three sets of orifices 16. In FIG. 1, a first set of orifices 16*a* corresponds to a first color, a second set of orifices 16*b* corresponds to a second color, and a third set of orifices 16*c* corresponds to a third color. Reservoir 12 includes three separate sub-reservoirs 12*a*–12*c* corresponding to orifices 16*a*–16*c* and holding three separate ink formulations. A suitable combination of ink droplets as selected from reservoirs 12*a*–12*c* produces a desired color or pattern in printed images produced by cartridge 10.

Figure 2:
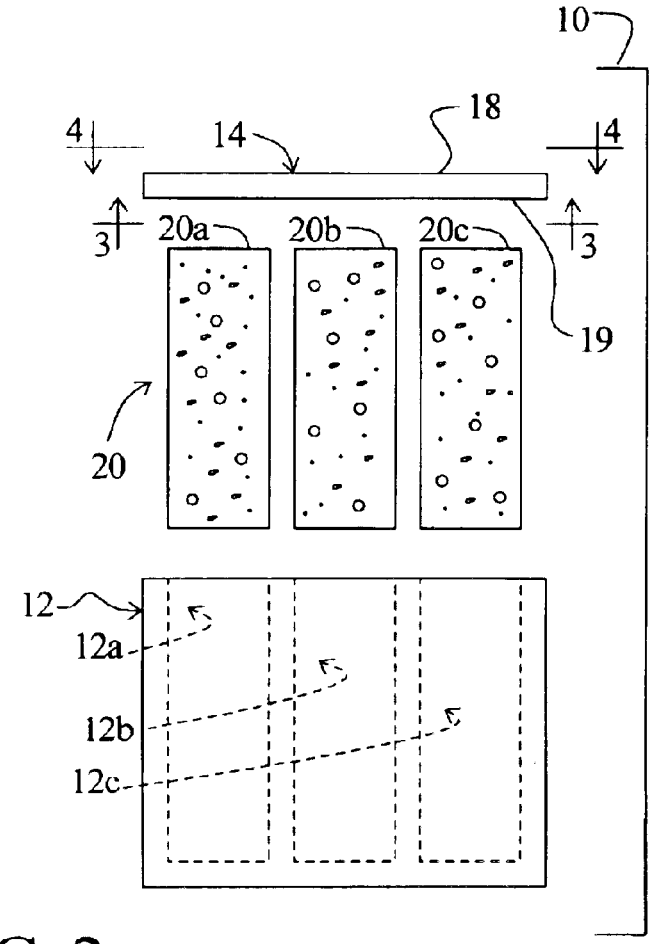
FIG. 2 illustrates in exploded assembly view the print cartridge of FIG. 1.

FIG. 2 illustrates cartridge 10 in exploded view. FIG. 2 omits the TAB circuit or cable 17, but such element is included in the TAB-head assembly at the time of constructing cartridge 10. In FIG. 2, reservoir 12 includes three separate ink reservoirs 12*a*–12*c* holding, for example, cyan, yellow, and magenta, respectively, ink formulations. An ink containment system 20 supplies ink to printhead 14. Each of reservoirs 12*a*–12*c* houses a foam, e.g., an open cell foam ink containment element, or fiber ink containment element 20*a*–20*c*, respectively. Generally, each of reservoirs 12*a*–12*c* presents a well or chamber formation having an open top through which elements 20*a*–20*c* pass during manufacture of cartridge 10. With elements 20*a*–20*c* located within the corresponding reservoirs 12*a*–12*c*, respectively, printhead 14 closes reservoirs 12*a*–12*c* thereby providing containment of ink in the containment elements 20*a*–20*c*. As will be discussed more fully hereafter, each of reservoirs 12*a*–12*c* fluidly couple to printhead 14 for collection of ink from reservoirs 12*a*–12*c* and ejection from printhead 14 during a printing operation. More particularly, each of ink containment elements 20*a*–20*c* contacts the rear-facing or reservoir-facing surface 19 of printhead 14. In this manner, ink carried by each of elements 20*a*–20*c* bears against surface 19 of printhead 14 allowing the ink to flow through the printhead 14 and be ejected through orifices 16*a*–16*c*.

As seen in FIG. 2, manufacture of cartridge 10 is accomplished by front-loading elements 20*a*–20*c* into reservoirs 12*a*–12*c*, respectively. In other words, elements 20*a*–20*c* enter cartridge 10 from the same opening covered by printhead 14. In this manner, reservoir 12 may be formed as a compartmentalized structure receiving containment elements 20 therein and printhead 14 as a closure and retention element therefor.

Figure 3:
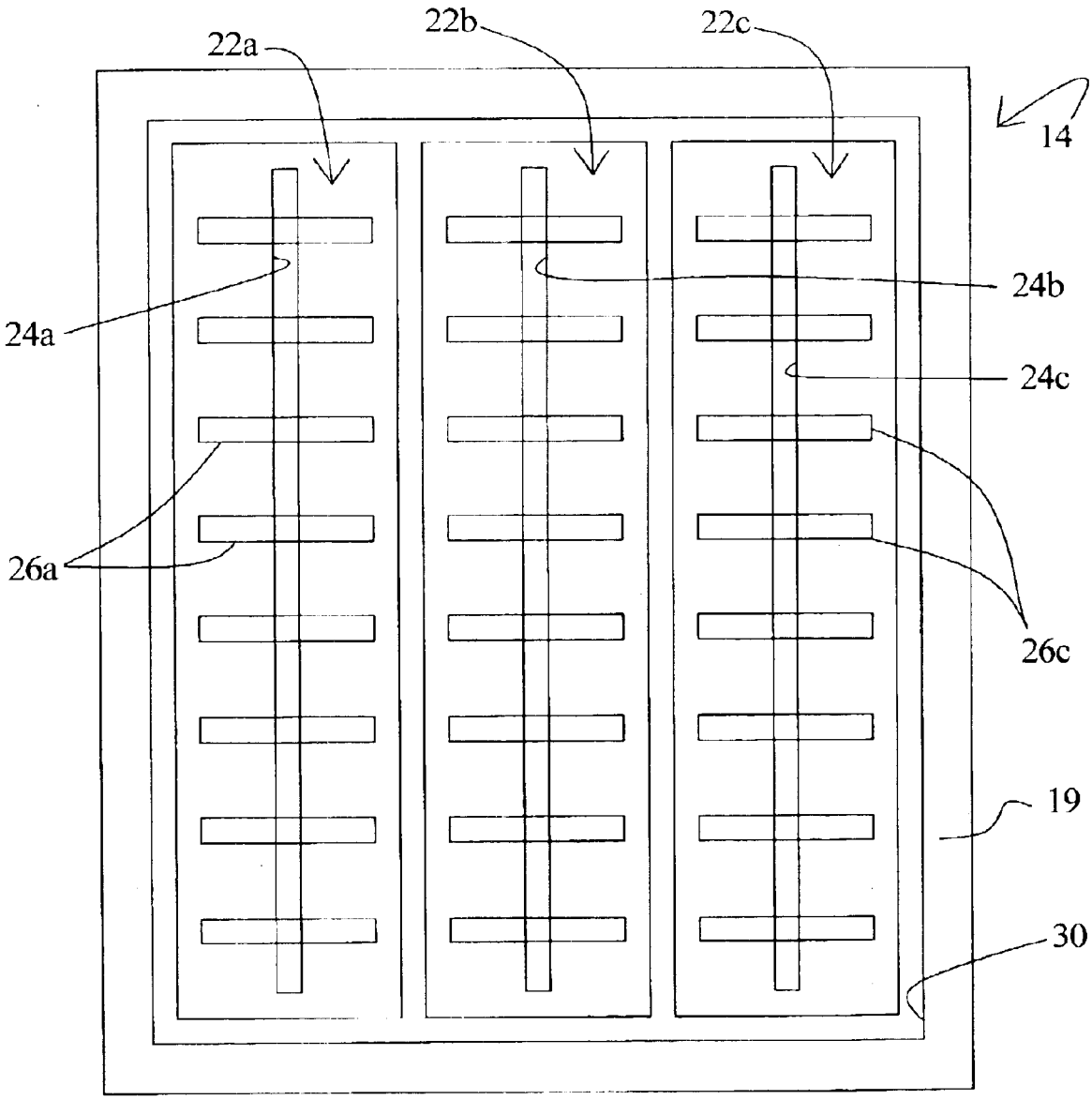
FIG. 3 illustrates a bottom view of a printhead of the cartridge of FIGS. 1 and 2 as taken along lines 3—3 of FIG. 2.
Figure 4:
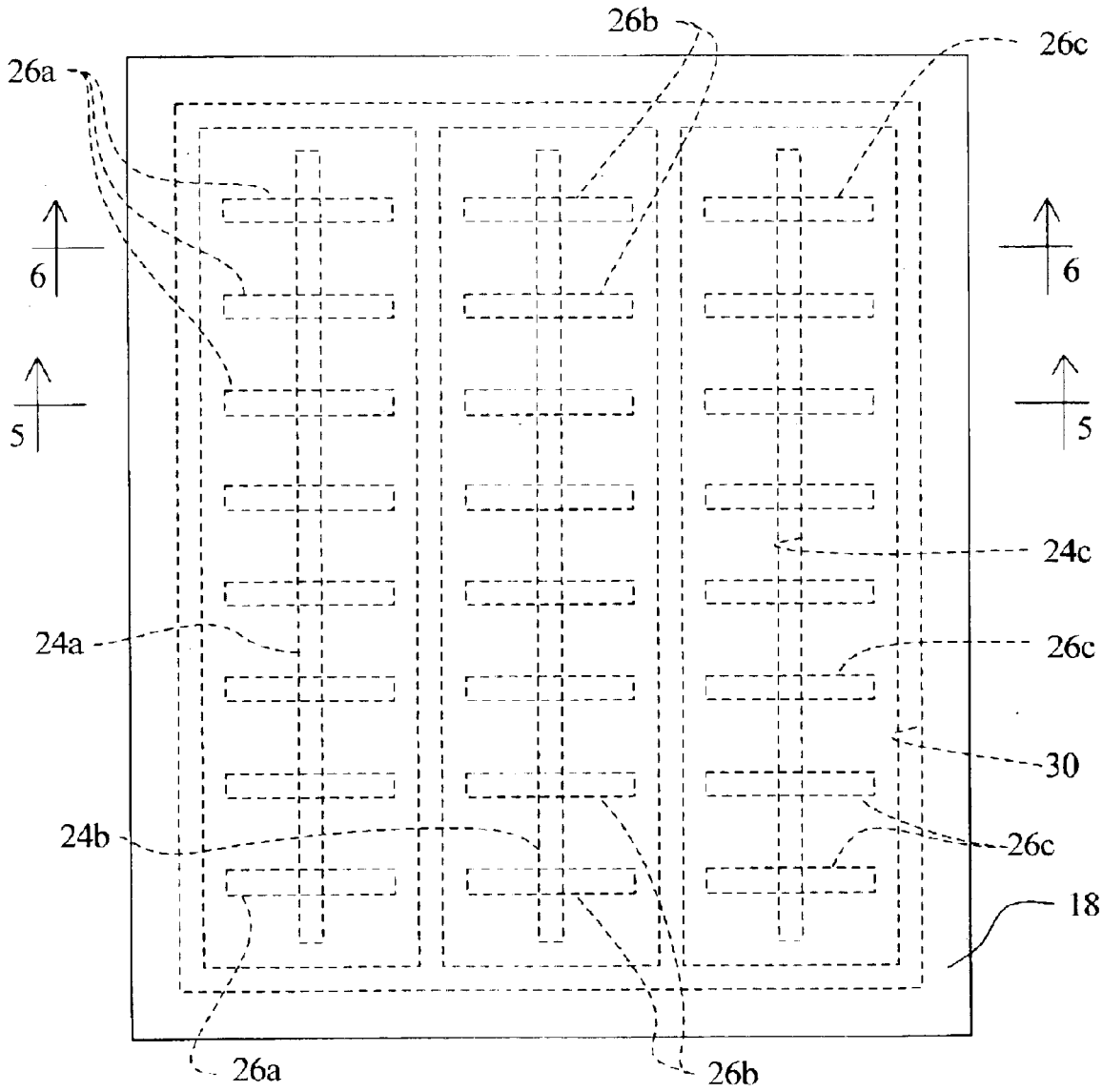
FIG. 4 illustrates in top view the printhead of FIGS. 2 and 3 as taken along lines 4—4 of FIG. 2.
Figure 5:
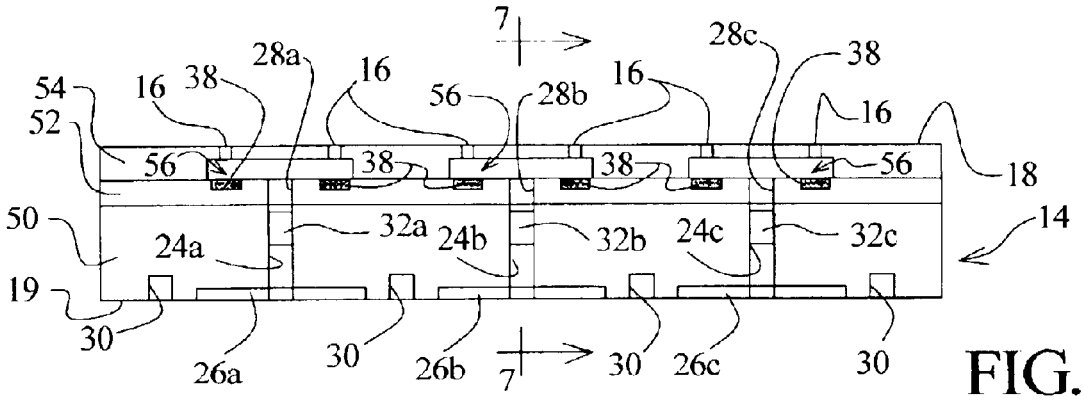
FIG. 5 illustrates in section the printhead of FIGS. 2–4 as taken along lines 5—5 of FIG. 4.
Figure 6:
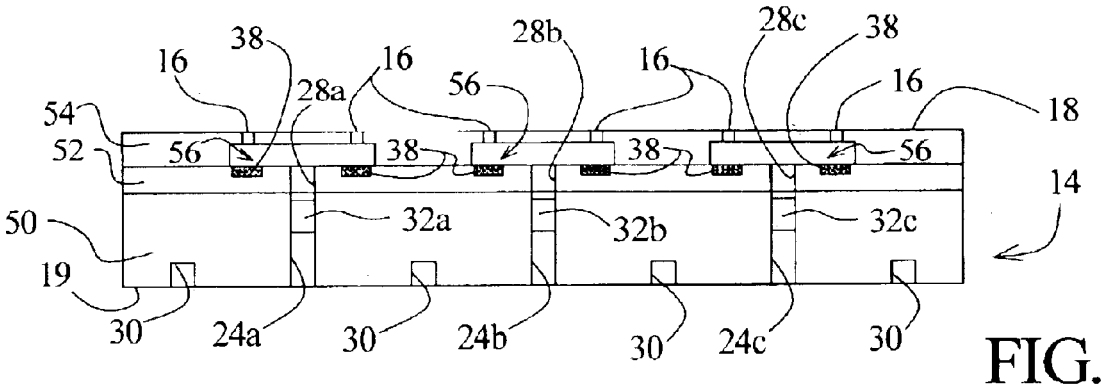
FIG. 6 illustrates in section the printhead of FIGS. 2–4 as taken along lines 6—6 of FIG. 4.
Figure 7:
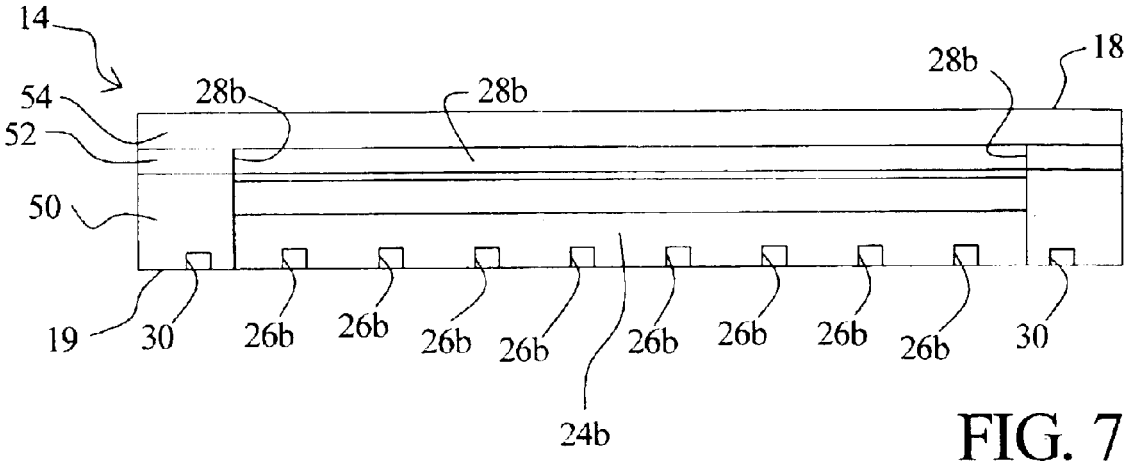
FIG. 7 illustrates in section the printhead of FIGS. 2–4 as taken along lines 7—7 of FIG. 4.
Figure 8:
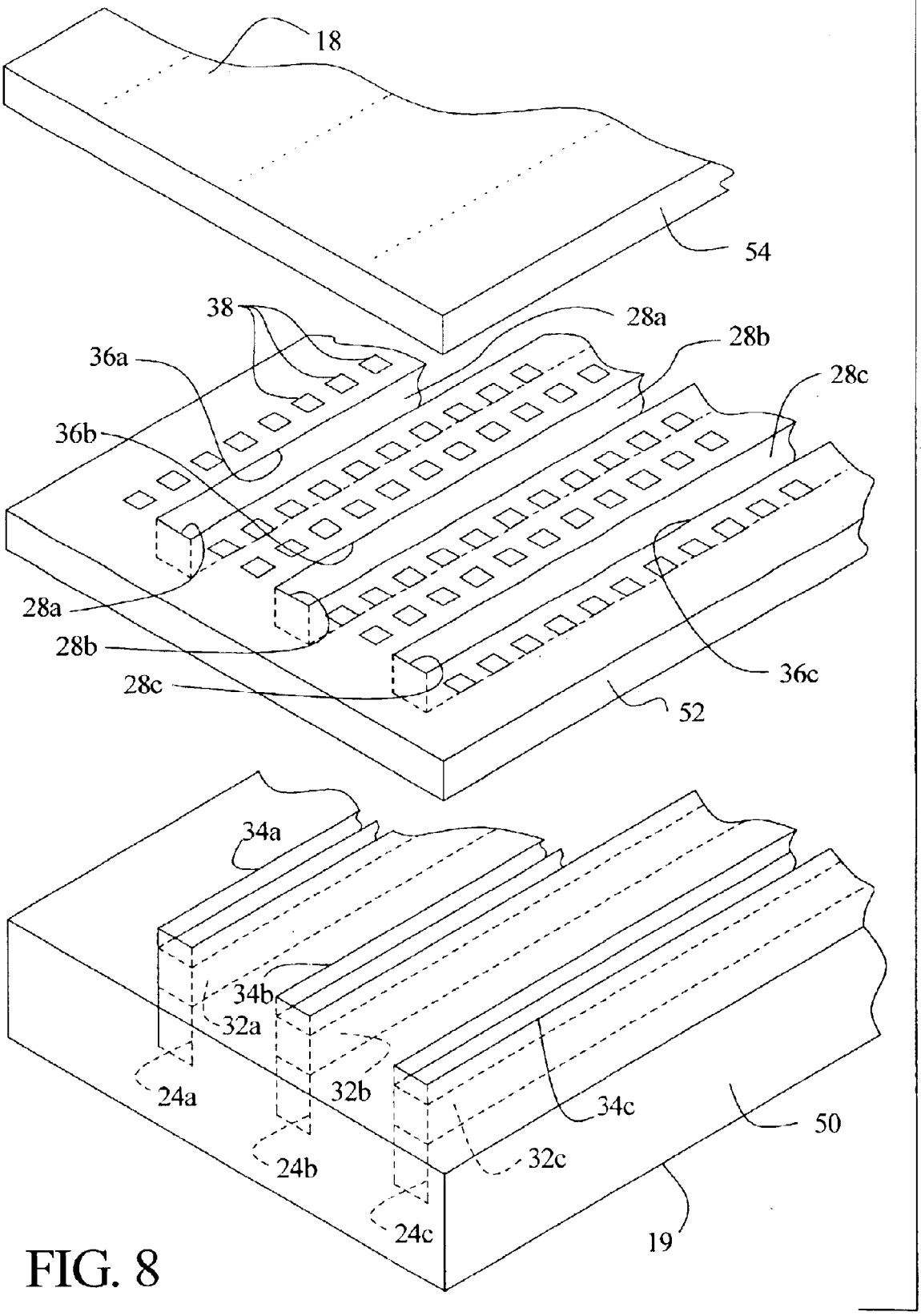
FIG. 8 illustrates in partial exploded view components of the printhead of FIGS. 2–4.

FIG. 3 illustrates printhead 14 as taken along 3—3 of FIG. 2. More particularly, FIG. 3 illustrates the backside or reservoir-facing surface 19 of printhead 14 as maintained in contact with ink containment system elements 20*a*–20*c*. FIG. 4 illustrates printhead 14 as taken along lines 4—4 of FIG. 2, i.e., illustrating surface 18 of printhead 14 as presented to media during print operations. FIGS. 5 and 6 illustrate printhead 14 in cross section as taken along lines 5—5 and lines 6—6, respectively, of FIG. 4.

Printhead 14 as provided under the illustrated embodiment of the present invention includes a silicon substrate 50, thin film layer 52, and orifice layer 54. As may be appreciated, substrate 50 serves as structural support for layers 52 and 54, and as described more fully hereafter, serves as an integrated filter membrane. Printhead 14 is thereby an integrated printhead in that its filtration, fluid feed, and fluid ejecting elements are formed relative to a common silicon substrate, such as formed from a single silicon substrate. While not specifically detailed throughout FIGS. 5–8, it will be understood that orifice layer 54 may incorporate a variety of architectures. For example, as illustrated in FIGS. 5 and 6, orifice layer 54 includes firing chambers 56 fluidly coupled to slots 28 and housing ink ejecting elements 38. In some embodiments ink ejecting elements 38 are resistive elements 38, whereby upon "firing" of selected resistive elements 38, ink within orifice layer 54 is expelled by ejection from a selected one of orifices 16. As described more fully hereafter, silicon substrate 50 lies in contact with the ink containment system 20 and carries ink therefrom into orifice layer 54. Thin film layer 52 includes slots 28, individually slots 28*a*–28*c*, fluidly coupling substrate feed channels 24 with orifice layer 54. Thin film layer 52 includes, in the particular embodiment illustrated, a plurality of resistive elements 38 coupled to appropriate control circuitry, e.g., by a TAB circuit or cable 17 (FIG. 1), for ejecting ink within chambers 56 of orifice layer 54 to project ink from orifices 16.

In FIG. 3, substrate 50 includes a set of ink feed ladders 22. Ladders 22 direct ink from ink containment elements 20 to channels 24. More particularly, substrate 50 includes ink feed features 22*a*–22*c* corresponding to reservoirs 12*a*–12*c*. Ladders 22 allow ink to be extracted from a greater portion of the access surface of the ink containment elements 20. By drawing ink from a greater portion of the access surface of the ink containment elements 20, ink extraction efficiency improves and printing performance thereby improves.

In FIGS. 3–5, each ladder 22 includes an ink feed channel 24 and a series of secondary ink feed channels 26 lying transverse thereto. Generally, channels 24 fluidly couple through substrate 50 while channels 26 are cut only partially into surface 19 of substrate 50. For each of channels 24*a*–24*c* corresponding to reservoirs 12*a*–12*c*, respectively, a set of secondary feed channels 26*a*–26*c*, respectively, fluidly couple thereto. In other words, channels 24 allow fluid passage through substrate 50 while channels 26 are only partially cut, i.e., trenched, into surface 19 of substrate 50. Channels 26*a* fluidly couple, i.e., intersect with, channel 24*a*; channels 26*b* fluidly couple with, i.e., intersect, channel 24*b*; and channels 26*c* fluidly couple with, i.e., intersect, channel 24*c*. Incorporating secondary feed channels 26 into the ink feed delivery conduits through substrate 50 can enhance access to the ink containment system 20. More particularly, channels 26 provide improved fluid coupling between substrate 50 and ink containment system 20. Channels 24 and 26 are formed by etching silicon substrate 50. An etched adhesive channel 30 runs peripherally about ladders 22*a*–22*c* and between ladders 22*a* and 22*b* and ladders 22*b* and 22*c*. As may be appreciated, adhesive channel 30 receives an adhesive material forming a seal between printhead 14 and reservoir 12 and isolating ink flow channels 24 and 26 to the reservoirs 12–12*c*.

Channels 24 terminate at an upper portal 34 (FIG. 8), individually, portals 34*a*–34*c* and present suitably filtered ink to slots 28*a*–28*c* of thin film layer 52. Slots 28*a*–28*c* carry filtered ink through thin film layer 52 to orifice layer 54 where it flows into the firing chambers 56 (FIGS. 5 and 6) thereof. More particularly, each of slots 28*a*–28*c* terminates at a portal 36*a*–36*c*. A pattern of ink ejection elements, e.g., resistive elements 38, reside about each of portals 36*a*–36*c*. The orifice layer 54 firing chambers 56 also include one or more of orifices 16 (FIGS. 5 and 6). Thus, activating, e.g., energizing by application of electrical energy therethrough, elements 38 superheats the ink forming a drive bubble which propels or ejects an ink droplet from the associated orifice 16.

Along the path formed by each of channels 24, a filter 32 resides. More particularly, filter 32*a* resides along channel 24*a*, filter 32*b* resides along channel 24*b*, and filter 32*c* resides along channel 24*c*. Each of filters 32 may be formed by etching silicon substrate 50. The extent of filters 32 along channels 24 can vary depending on implementation. Filters 32 can extend sufficiently along channels 24 to reach or directly contact ink containment elements 20 when printhead 14 comes into contact with elements 20 at cartridge 10 manufacture and as filters 32 remain in such contact during cartridge 10 operation.

Filters 32 can be formed by a number of different etching processes including wet etching, dry etching, or a combination of wet and dry etching. Generally, filters 32 each run the length of the corresponding channel 24 and are of selected thickness. Each filter 32 includes apertures of selected size and number to accomplish suitable fluid, e.g., ink, filtering. Thus, ink reaching the firing chambers 56 of orifice layer 54 carries no particulates of size greater than that allowed to pass through filters 32. While illustrated schematically in FIGS. 5–8, it will be understood that filters 32 may be formed including ink filtration passageways or apertures of selected size according to a selected etching process to establish filtration against particulates of given size. In this manner, filtration may be incorporated into printhead 14 just upstream from chambers 56. As a result, ink entering chambers 56 is suitably filtered and carried forward into the firing chamber and ejected according to selected firing of resistive elements 38.

A useful embodiment of a printhead according to the present invention is a micro-printhead. A micro-printhead as applied to a micro-printing application may be incorporated into a camera, PDA, laptop computer, notebook computer or other small, portable device.

A three-color micro printhead with a ⅓" print swath and a 600 dpi nozzle resolution finds use in a hand held or mobile printing application. In order to print at least twenty-four 4"×5" images, consuming approximately 0.03 to 0.05 cc's of ink per image, and accounting for water loss during storage and 50% ink extraction efficiency from the foam or fiber ink containment system, each ink chamber holds between 1.8 cc and 2.0 cc of ink for a three color system. For a six-color system, each ink chamber holds 0.9 cc to 1.0 cc ink.

A micro-printhead according to embodiments of the present invention produces images. For example, the weight of the ink drops producing images is in the range of 2 to 8 pico liters. Given the small architecture features (orifice diameter, ink channel, etc.) the firing chamber and orifice layer according to certain embodiments of the present invention is composed of a photo-imageable material such as SU8. A metal or Kapton (trademark registered to E. I. Du Pont De Nemours And Company Corporation) orifice plate and polymer barrier layer is used in certain embodiments of the present invention. Based on these printhead performance considerations and assuming 100% density printing, the ink flow rate is approximately 0.2 cc/minute. If the pressure drop across the filter is approximately 1" H2O, the ink viscosity is 0.03 dyne sec/cm2, and the flow loss coefficient of the filter is approximately 1,000,000 l/cm, then a suggested filter area is approximately 6 sq. mm. Based on a ⅓" print swath, the filter is approximately 0.75 mm wide. To allow for some of the filter passages to be blocked by particulates and to account for manufacturing tolerances, the overall filter dimensions are increased to approximately 8 sq. mm.

When constructing a micro-printhead embodiment as described herein, air accumulation within various portions of the cartridge can be managed without interfering with print operations.

Air accumulation originates from a number of sources including air trapped in the printhead during manufacturing, out-gassing of air from ink when the ink is heated during printing, and absorption of ambient air into the printhead due to air permeability of the pen or cartridge body. An ability to warehouse accumulated air accommodates changes in ambient temperature or pressure, which might otherwise cause the printhead to loose backpressure and uncontrollably "drool" or loose ink. A number of factors may be considered in setting air-holding volume including: residual air in the printhead following manufacturing, the total volume of ink to be ejected by the printhead over its life, the air permeability of the materials used to fabricate the printhead, and environmental conditions, including temperature and humidity, that the printhead may encounter.

According to embodiments of the present invention, the volume of ink ejected by the printhead is reduced from the 20 to 40 cc of ink typical for standard-sized printheads down to 2 to 5 cc for a micro-printhead, the ink is formulated to reduce out gassing, e.g., by increasing the organic content of the ink vehicle, and the ink fill process is designed to reduce trapped air. As a result, the size of the air-holding volume can be significantly reduced. This reduction in air-holding volume helps reduce the overall size of the print cartridge.

The following disclosure illustrates a variety of alternative printheads embodying the present invention. More particularly, the following printheads may be used in a print cartridge, e.g., cartridge 10, where an ink containment system, e.g., containment system 20 including foam or fiber elements 20*a*–20*c*, applies to or contacts the back-side or reservoir-facing surface of the printhead and where filtration functions are integrally incorporated into the printhead. Generally, the following embodiments of printheads are well suited for micro-printhead applications, but may be applied in a variety of contexts, e.g., may be applied in a variety of print cartridge sizes and contexts of use.

Figure 9:
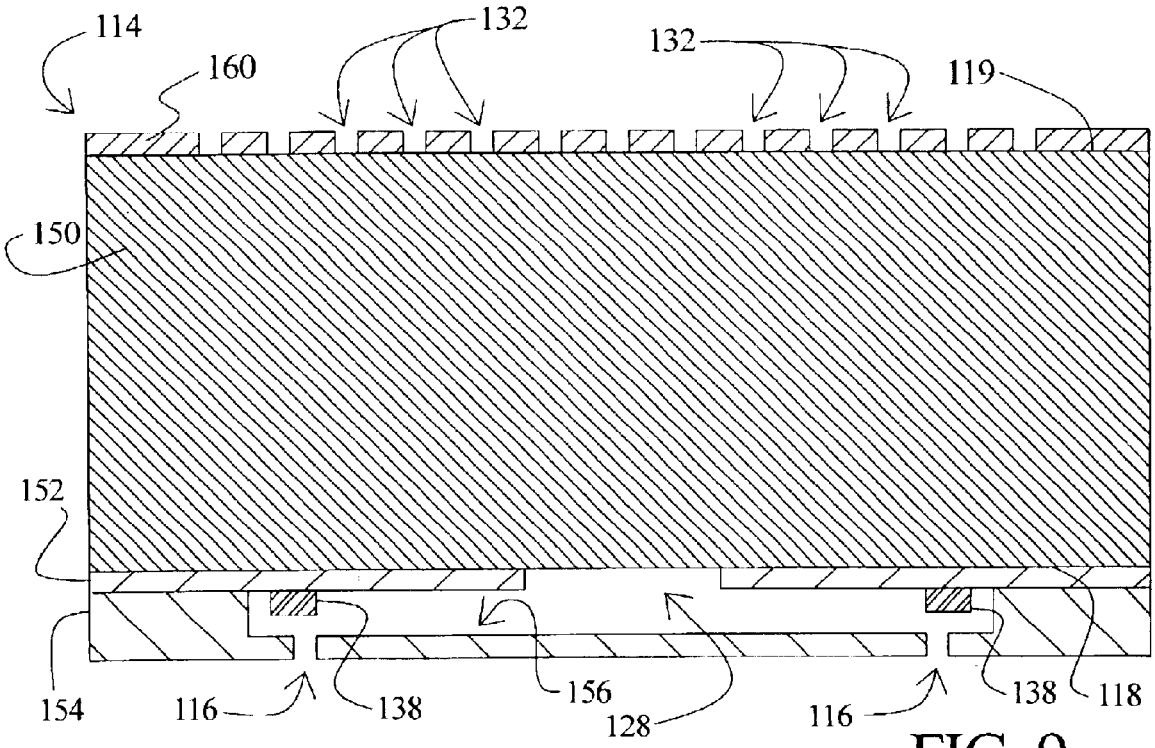
FIGS. 9–12 illustrate through a series of manufacturing steps an integrated printhead and filter according to an embodiment of the present invention.

FIGS. 9–12 illustrate through a series of manufacturing steps an integrated printhead 114 with a silicon (Si) backside filter. In FIG. 9, filter 114 includes a silicon substrate 150 and, attached thereto, thin film layers 152 and orifice layer 154. As may be appreciated, substrate 150 serves as structural support for layers 152 and 154, and as described more fully hereafter, serves as an integrated filter membrane.

Printhead 114 is thereby an integrated printhead in that its filtration, fluid feed, and fluid ejecting elements are formed relative to a common silicon substrate. Layers 152 and layer 154 are formed on the front side, or media-facing side, 118 of silicon substrate 150. Thin film layers 152 include slots 128 therethrough permitting ink flow from substrate 150 into orifice layer 154, e.g., into chamber 156 of orifice layer 154. While not illustrated in FIGS. 9–12, printhead 114 can include a TAB circuit or cable 17 such as shown in FIG. 1 for printhead 14 to couple ink-ejecting elements of thin film layer 154 with external control circuitry (not shown). Together, printhead 14 and TAB circuit 17 provide a TAB-head assembly. As may be appreciated, chamber 156 opens at orifices 116 and contains ink-ejecting elements, e.g., resistive elements 138, whereby upon "firing" of a selected resistive element 138 a corresponding orifice 116 ejects an ink droplet.

Figure 10:
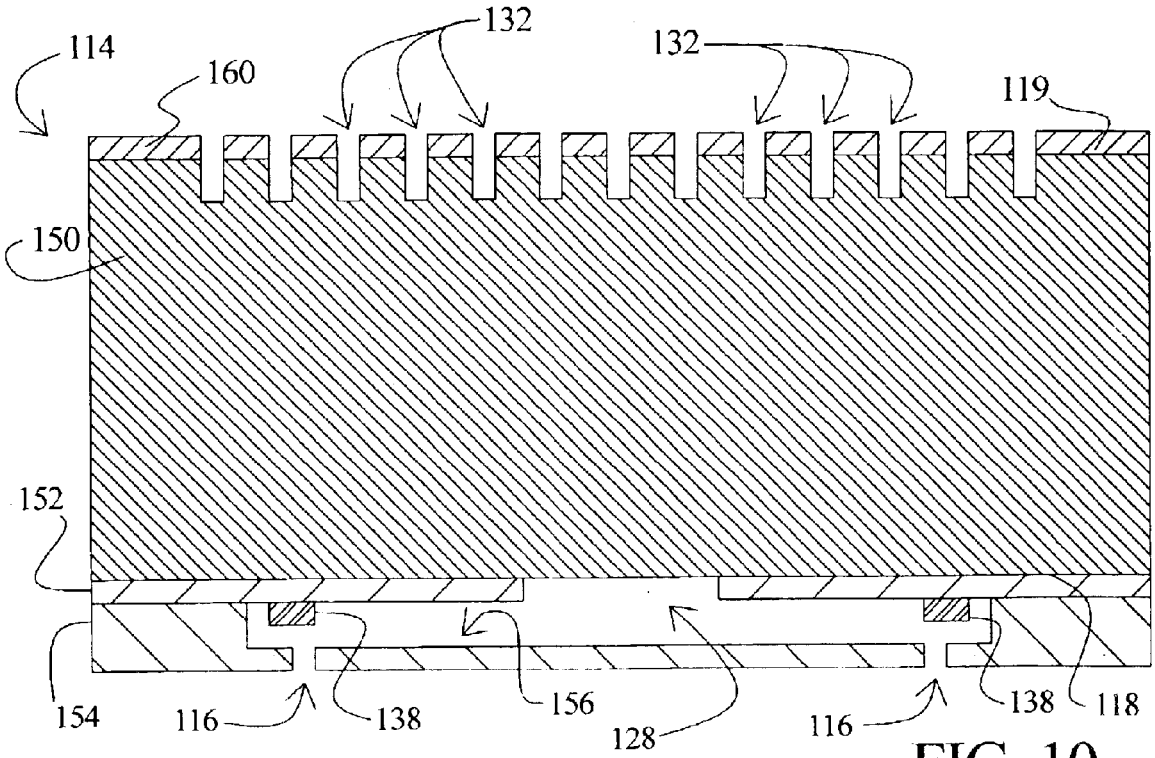

A hard mask layer 160, such as field oxide (Fox), is thermally grown or deposited on the opposite or backside 119 of substrate 150. A photo-imagable photo resist is applied to hard mask layer 160. Upon exposure, development, and etching of layer 160, filter hole pattern 132 appears in layer 160. In FIG. 10, the backside 119 of substrate 150, i.e., at layer 160, is etched using, for example, a Bosch dry etching process. The holes of filter hole pattern 132 can be coated with, for instance, a florinated polymer to protect the sidewalls thereof. As seen in FIG. 10, this etching results in initial deepening of the filter hole pattern 132 into the backside 119 of substrate 150.

Figure 11:
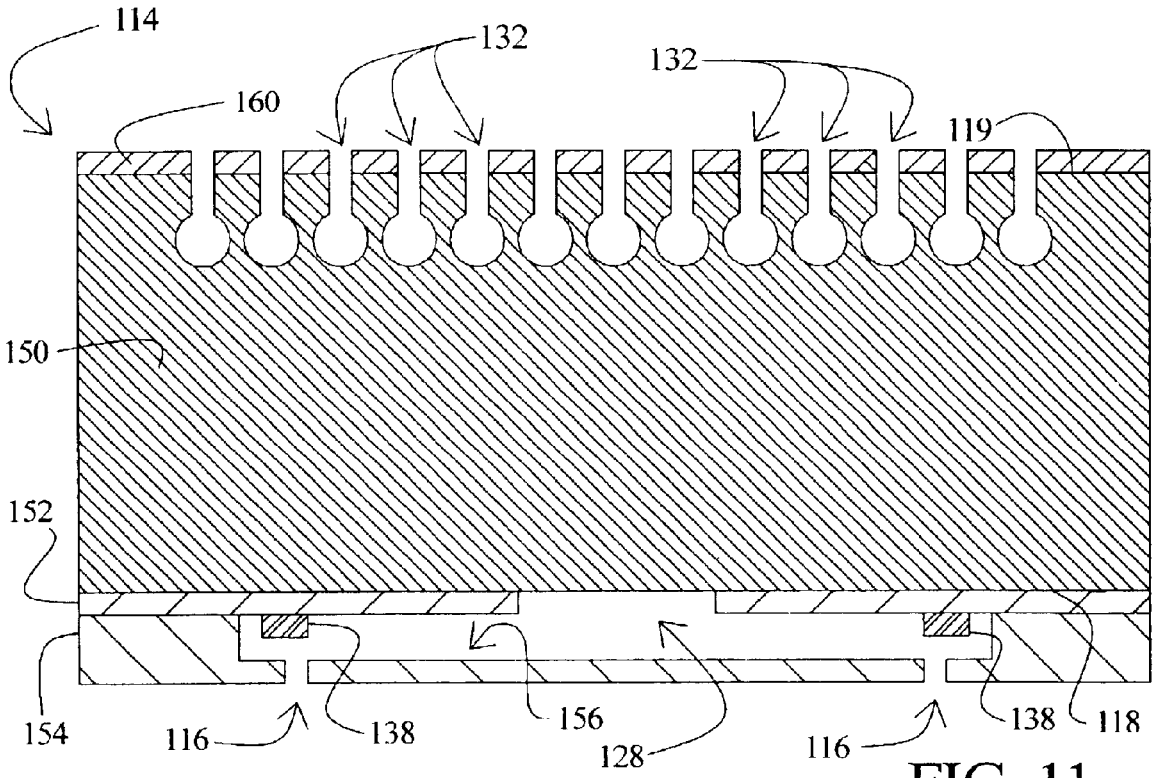
Figure 12:
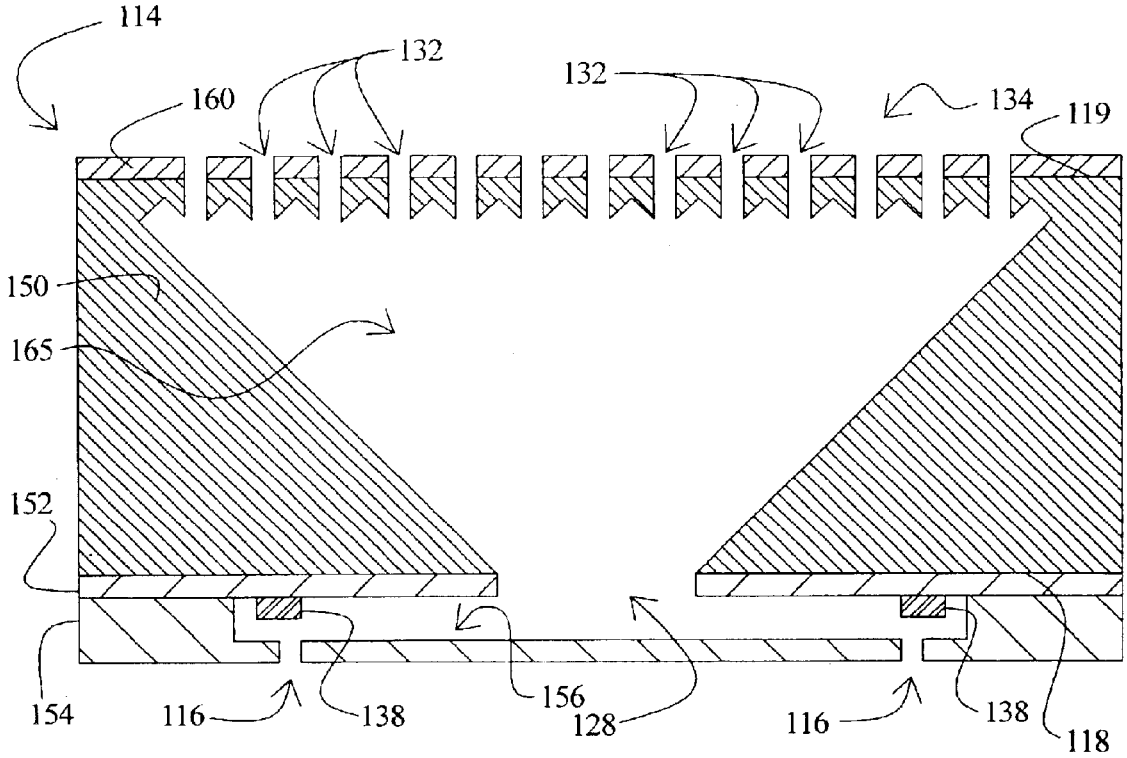

In FIG. 11, a second optional isotropic dry etch can be performed to enlarge and connect the holes of pattern 132. This establishes a faster subsequent wet etching of the <100> crystal plane to form an ink feed trench 165 as discussed hereafter and illustrated in FIG. 12. It is suggested that residual florinated polymer be cleared from the bottom of the trench to initiate etching of the <100> crystal plane while leaving it on the sidewalls to inhibit further etching thereat. In FIG. 12, substrate 150 is anisotropically etched using TMAH or KOH to form ink feed trench 165 thru substrate 150. This etch substantially terminates, i.e., slows substantially, at the thin film layers 152 as positioned at surface 119 of substrate 150.

As best seen in FIG. 12, the resulting structure of printhead 114 includes a filter membrane 134 across surface 119 of substrate 150 including pattern 132 thereacross. As may be appreciated, ink passes through membrane 134, but particulates of given size are blocked thereat according to the size of the holes in pattern 132. Trench 165, therefore, carries filtered ink which in turn flows through slot 128 of layer 152 and into chamber 156 of orifice layer 154. In this manner, placing ink containment system 20 against membrane 134 permits ink to flow through membrane 134 for filtration thereat, through trench 165, into chamber 156, and eventually to be ejected from printhead 114 at orifices 116. It should be noted that filter membrane 134 might be subjected to thermal and mechanical stress during assembly of printhead 114. To alleviate such stress, membrane 134 can include thin slots (not shown) along the edge of membrane 134 to provide compliance and stress relief.

Figure 13:
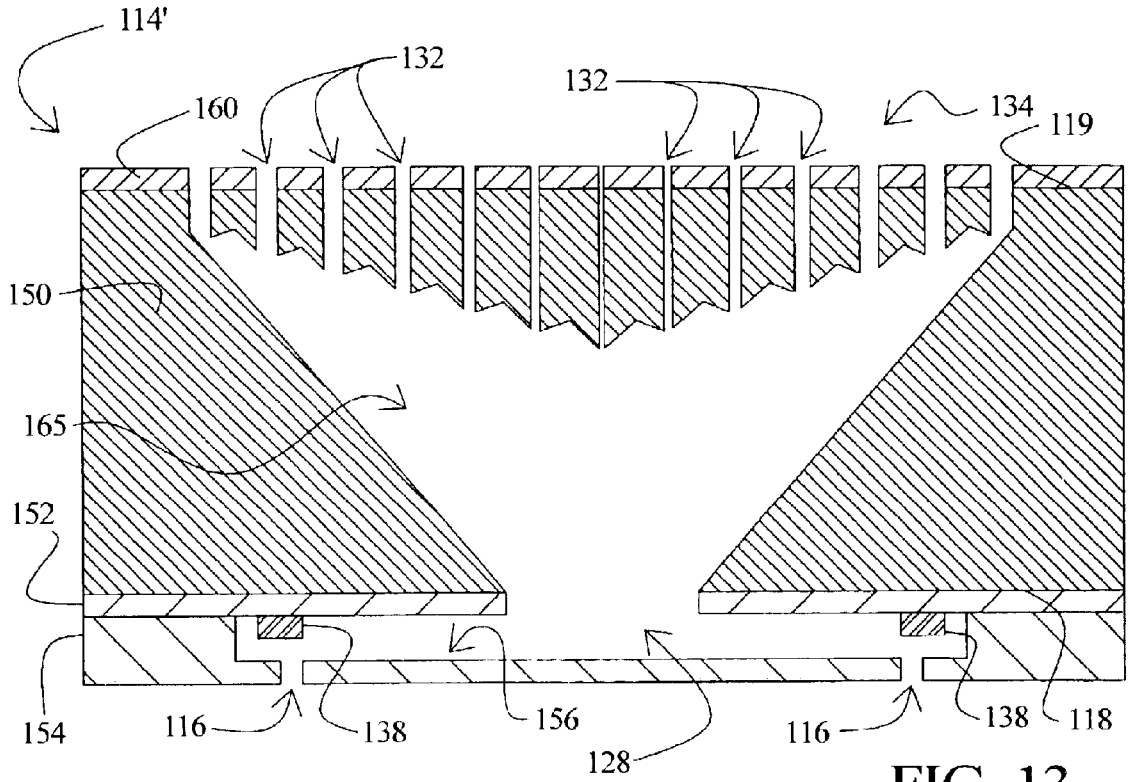
FIG. 13 illustrates an alternative form of the printhead of FIGS. 9–12 according to an embodiment of the present invention.

FIG. 13 illustrates an alternative printhead 114' similar to printhead 114 but adapted to accommodate air accumulation. Generally, printhead 114 may be constructed in fashion similar to printhead 114. By varying the size of holes in pattern 132, however, the depth or thickness of membrane 134 varies. The etch rate across membrane 132 varies because larger holes etch faster, e.g., as under the Bosch method operating in diffusion-limited regimes. This causes a variation in depth or thickness of membrane 134. In the particular example illustrated in FIG. 13, the central portion of membrane 134 is thicker than the edge portions as viewed in FIG. 13. As a result, the upper portion of trench 165, e.g., the interior surface of membrane 134, presents an inclined surface whereby air may be trapped at the highest points, e.g., at the edge portions of membrane 134, thereby preventing accumulated air bubbles from blocking the entire membrane 134 filtering surface.

Figure 14:
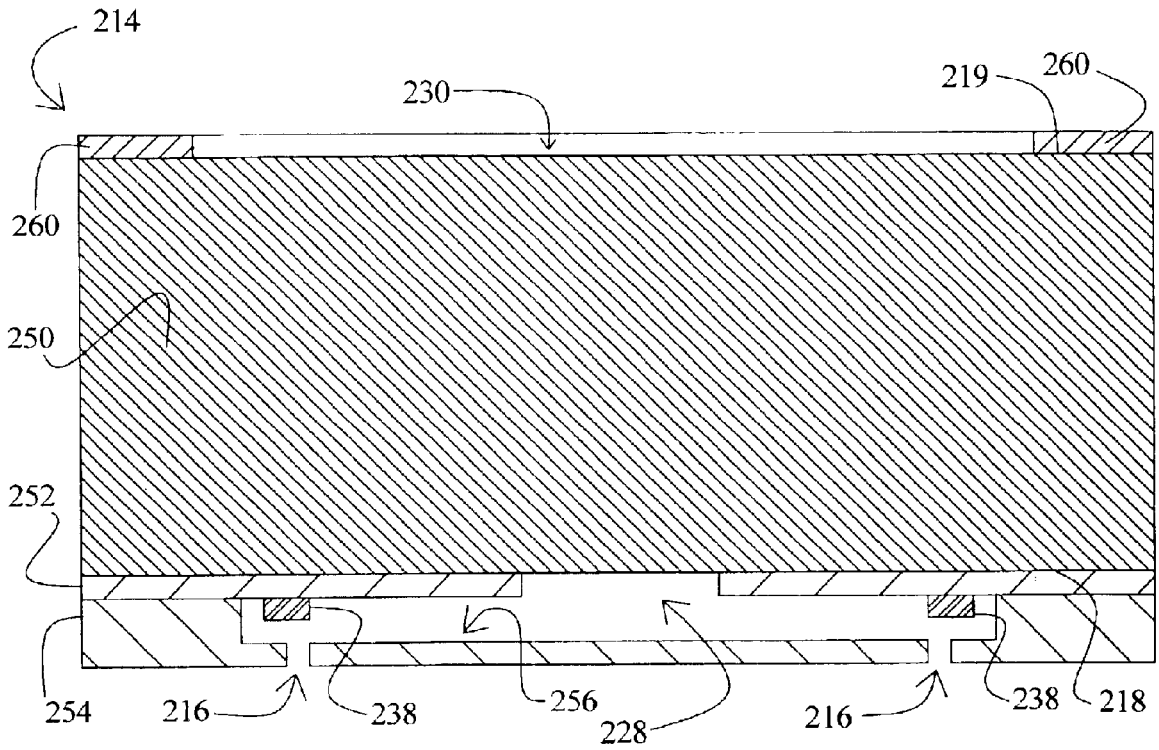
FIGS. 14–17 illustrate through a series of manufacturing steps another alternative printhead according to an embodiment of the present invention.

FIGS. 14–17 illustrate through a series of manufacturing steps an alternative printhead 214 with an integrated silicon (Si) backside filter. In FIG. 14, thin film layers 252 and orifice layer 254 are formed on side 218 of the silicon substrate 250. As may be appreciated, substrate 250 serves as structural support for layers 252 and 254, and as described more fully hereafter, serves as an integrated filter membrane. Printhead 214 is thereby an integrated printhead in that its filtration, fluid feed, and fluid ejecting elements are formed relative to a common silicon substrate. Thin film layers 252 include slots 228 and orifice layer 254 includes chamber 256 with ink ejecting elements, e.g., resistive elements 238, therein and orifices 216 coupled thereto. While not illustrated in FIGS. 14–17, printhead 214 can include a TAB circuit or cable 17 such as shown in FIG. 1 for printhead 14 to couple ink-ejecting elements of thin film layer 254 with external control circuitry (not shown). Together, printhead 214 and TAB circuit 17 provide a TAB-head assembly.

Figure 15:
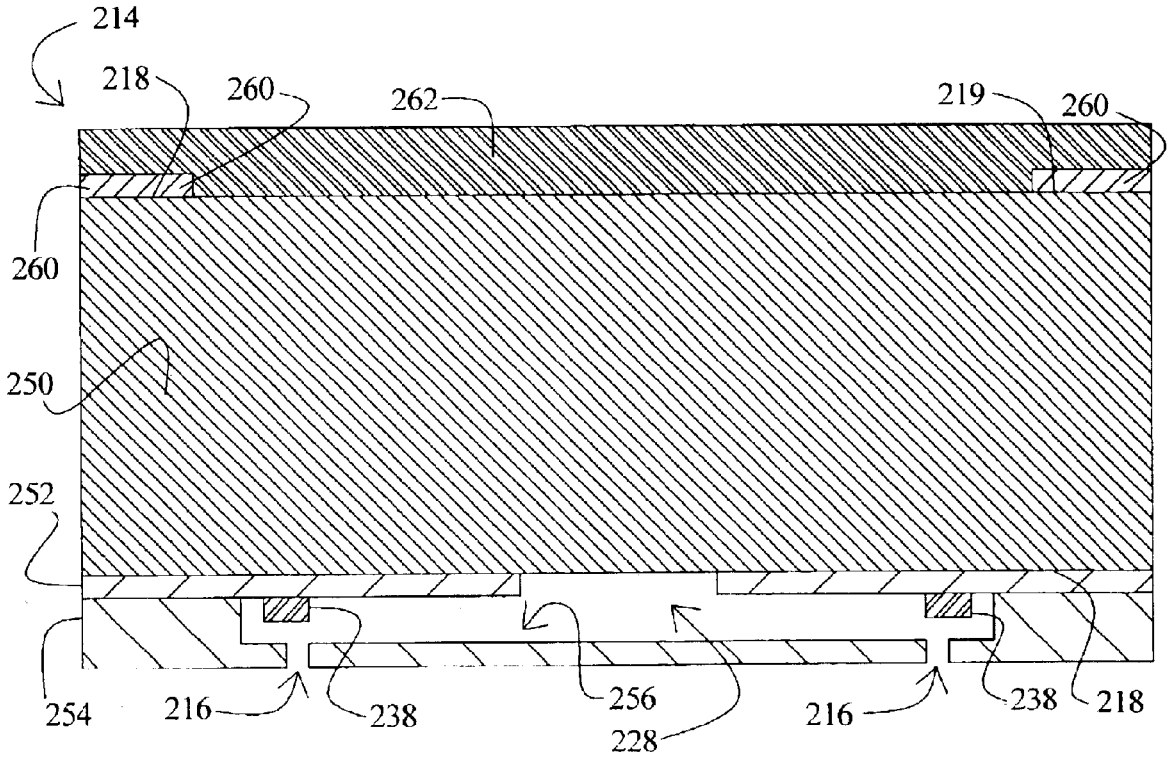
Figure 16:
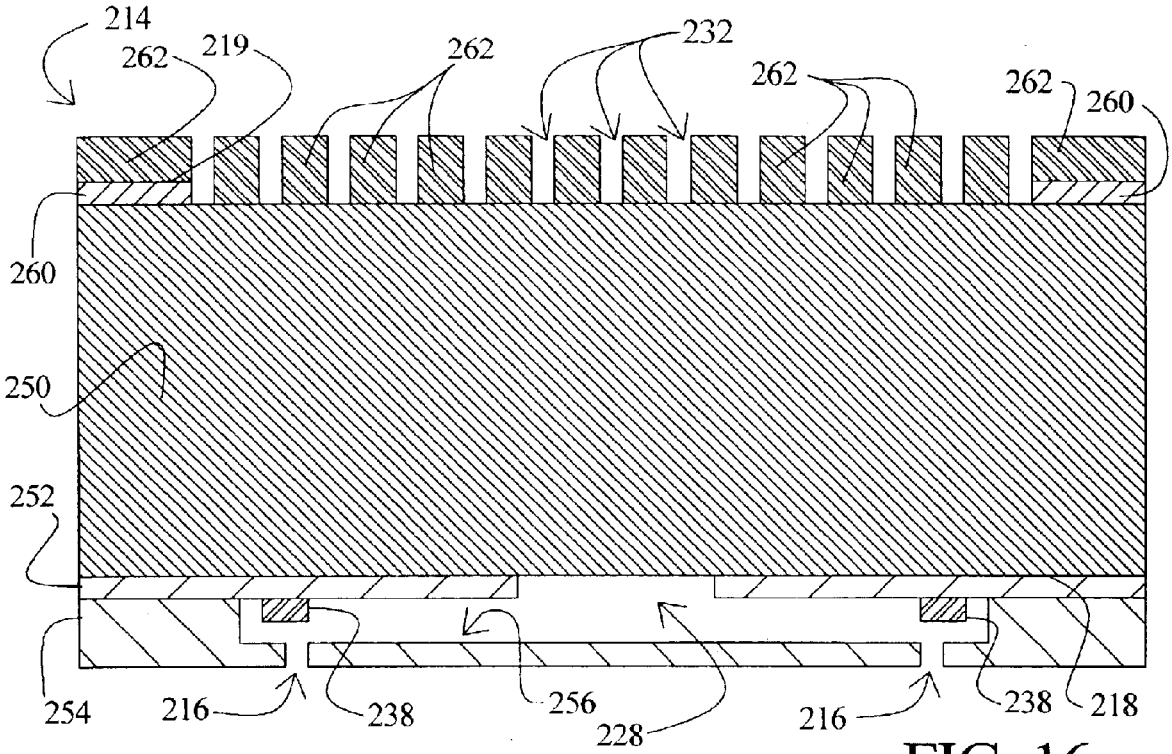
Figure 17:
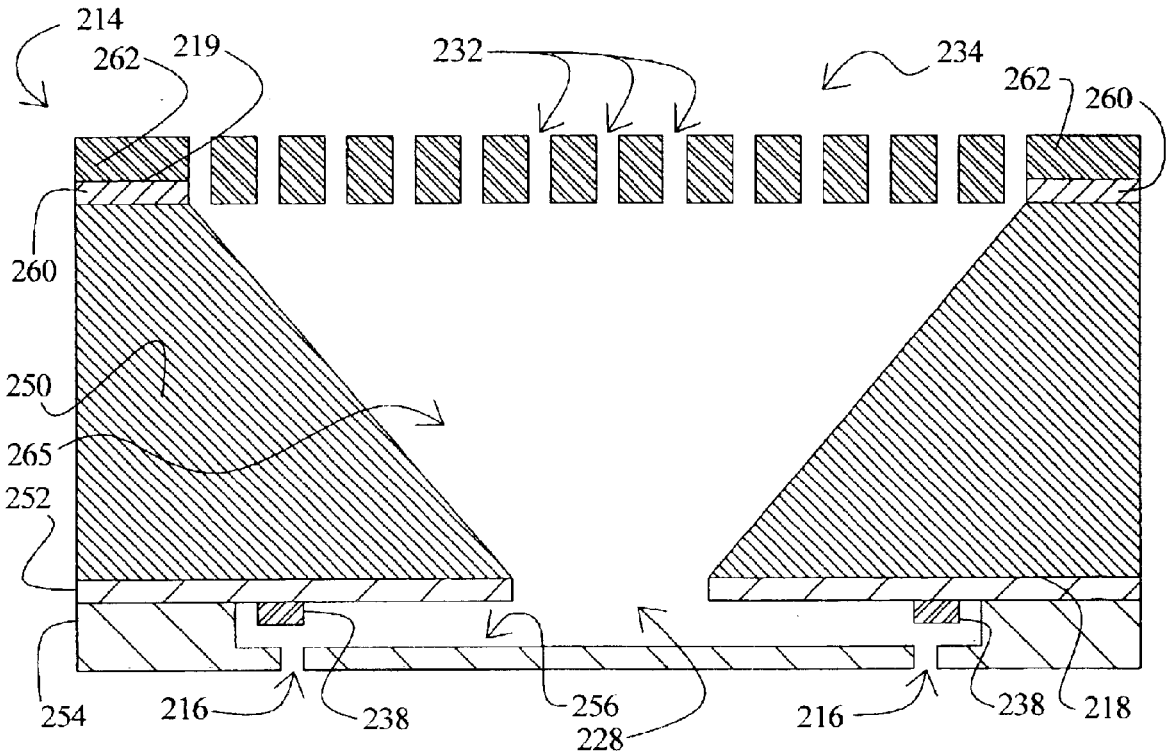

A hard mask layer 260, such as field oxide (Fox) is thermally grown on side 219 of silicon substrate 250. A photo imageable photo resist is applied to the hard mask layer 260 and, following suitable exposure, development, and etching defines a trench pattern 230. In FIG. 15, a thick photo resist 262 is spun on the backside of silicon substrate 250. This material can be a photo imageable polymer such as SU8 as manufactured by Micro Chem Corporation (MCC). The thickness of the photo resist 262 is defined by the aspect ratio of its thickness to the imaged feature size. For a 6–12 um hole, the resist 262 would be between 15 and 30 um thick. In FIG. 16, the SU8 is exposed and developed to form the desired filter hole pattern 232. In FIG. 17, silicon substrate 250 is then anisotropically etched using, for example, TMAH or KOH, to from a feed trench 265 thru silicon substrate 250. The etch substantially terminates, i.e., slows significantly, at the thin film layers 252 as located at side 218, or media-facing side, of silicon substrate 250.

Following formation of trench 265, a filter membrane 234 exists as the remains of photo resist layer 262 with filter hole pattern 232 dispersed thereacross. Placing an ink containment system, e.g., the access surface of one of elements 20*a*–20*c*, against membrane 234 permits ink flow through filter membrane 234, into trench 265, through slot 228, and into chamber 256 of orifice layer 254. By selectively firing resistive elements 238, ink droplets may be selectively ejected from orifices 216.

Figure 18:
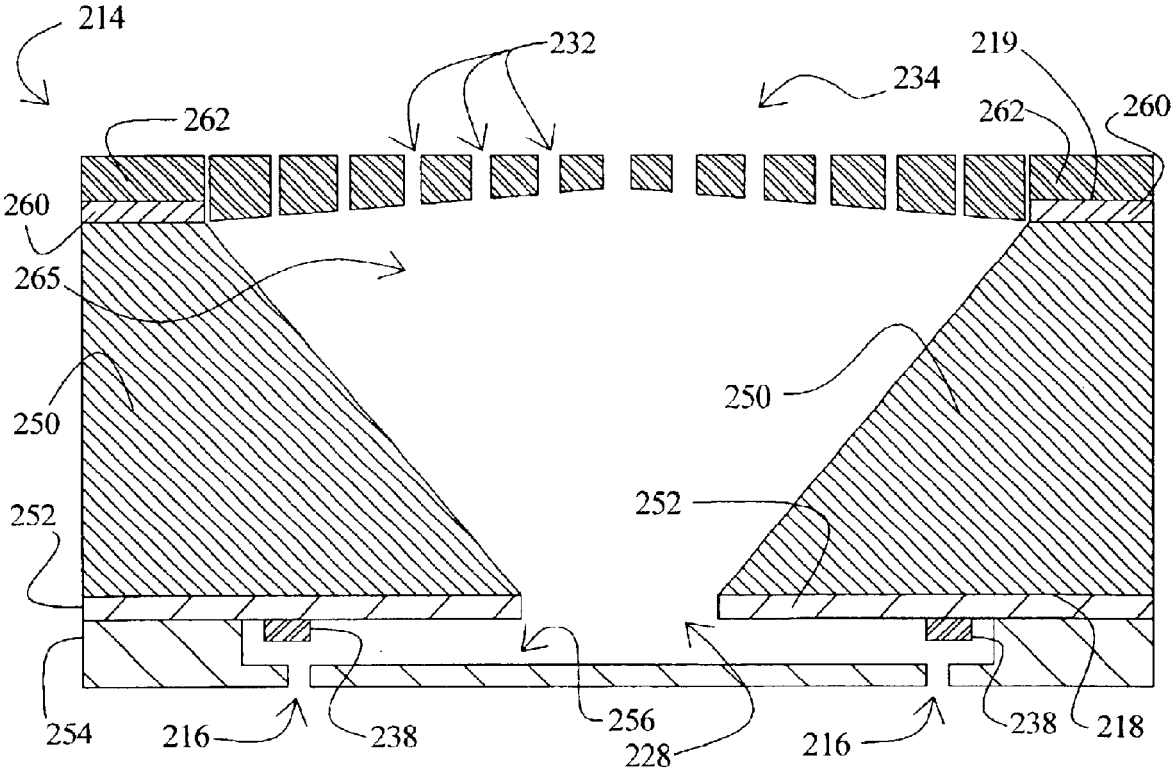
FIG. 18 illustrates an alternative embodiment of the present invention similar to the embodiments of FIGS. 14–17.

FIG. 18 illustrates an alternative printhead 214' similar to printhead 214, but modified to accommodate air accumulation. In the particular embodiment illustrated in FIG. 18, a relatively thinner portion of membrane 232 exists at the mid-portion of membrane 232 with thicker portions at the edges thereof. By using a negative resist with variation in exposure energy across the membrane, one obtains variation in membrane thickness. In this particular embodiment, air thereby accumulates at the relatively thinner portion centrally positioned relative to membrane 234.

Figure 19:
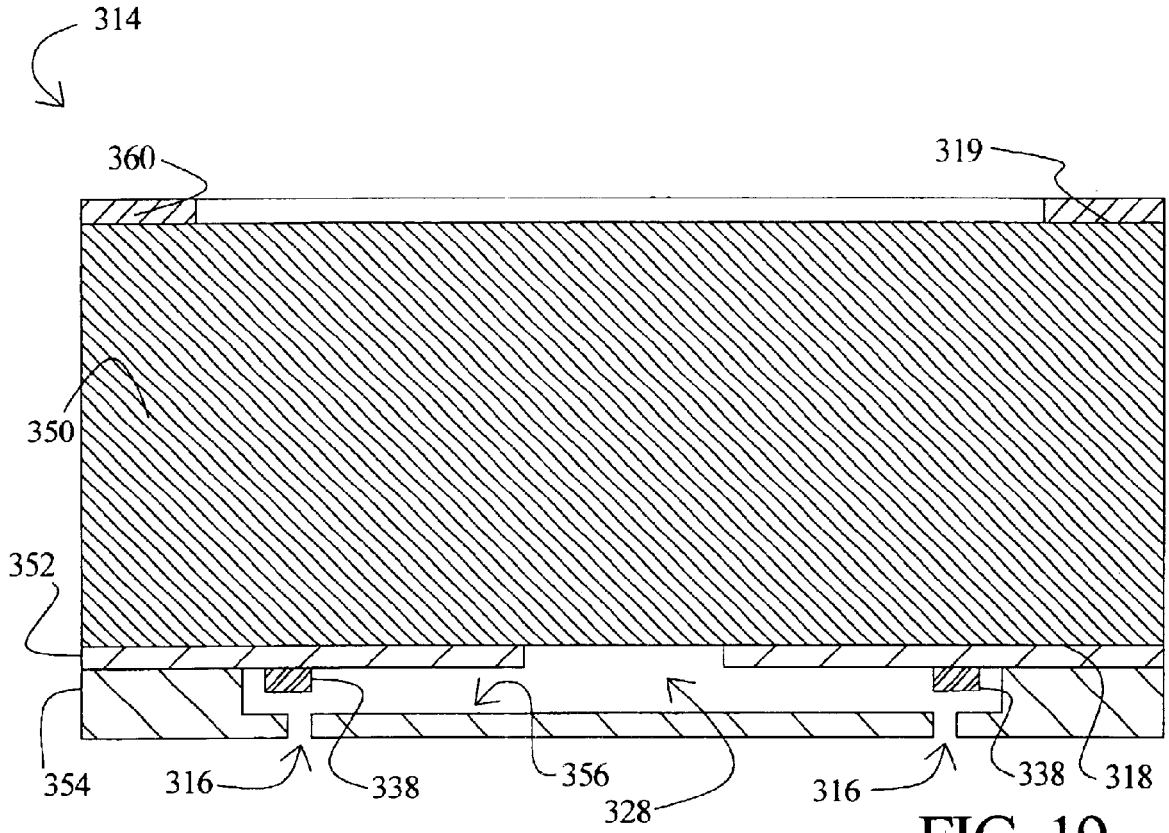
FIGS. 19–21 illustrate through a series of manufacturing steps a bonded polymer membrane printhead filter according to another embodiment of the present invention.
Figure 20:
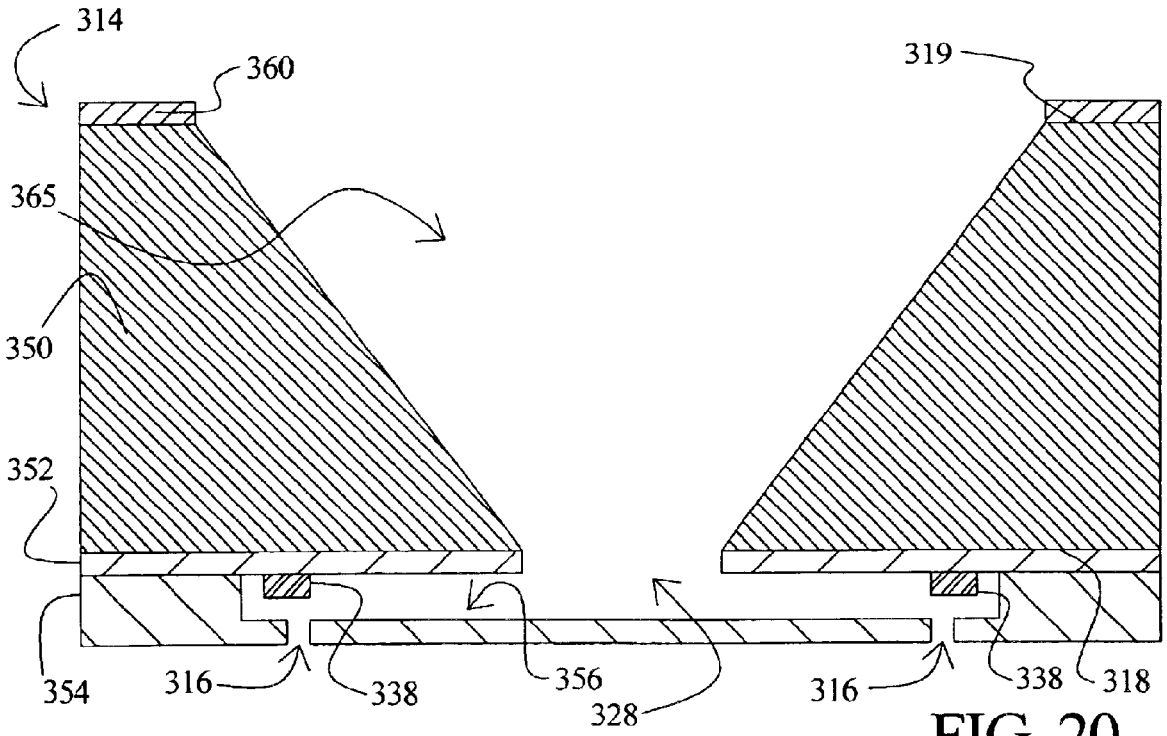
Figure 21:
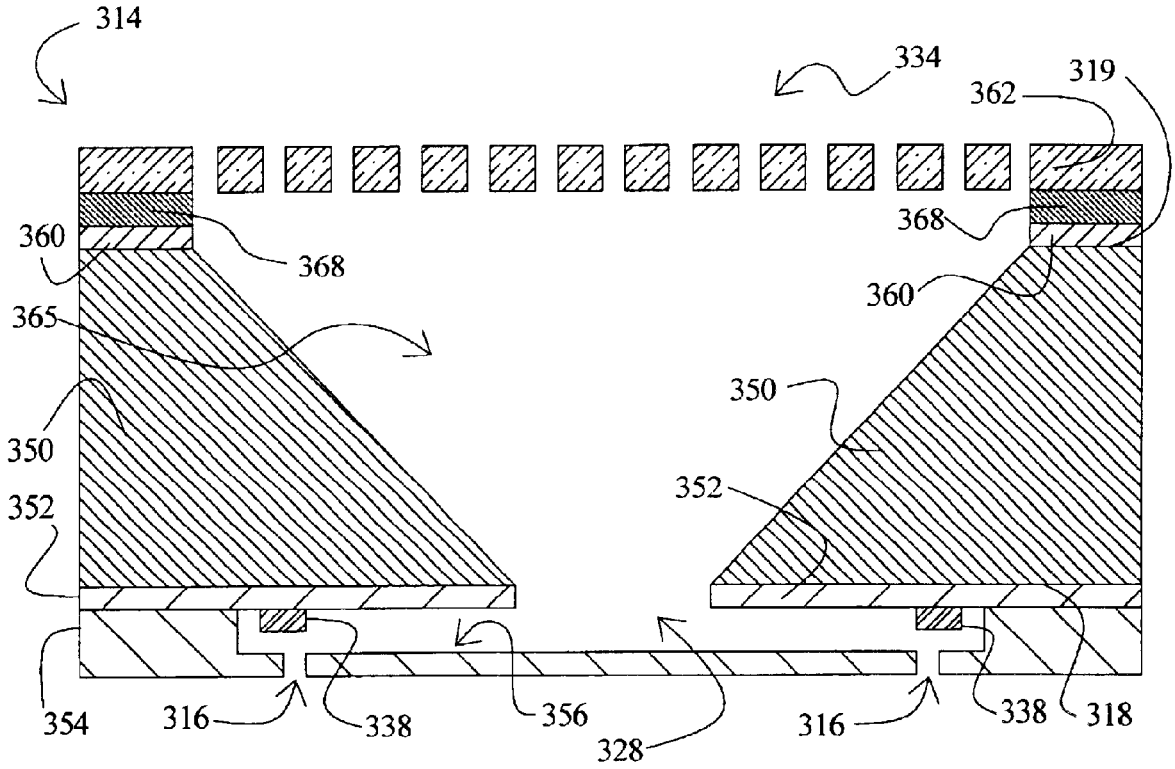

FIGS. 19–21 illustrate through a series of manufacturing steps a bonded polymer membrane printhead filter 314. As illustrated in FIG. 19, printhead 314 includes a silicon substrate 350, thin layers 352, and orifice layer 354 generally similar to above-described embodiments of printheads. As may be appreciated, substrate 350 serves as structural support for layers 352 and 354, and as described more fully hereafter, serves as an integrated filter membrane. Printhead 314 is thereby an integrated printhead in that its filtration feed trench, e.g., between the filter and fluid ejecting elements, and its fluid ejecting elements are formed relative to a common silicon substrate. Orifice layer 354 includes resistive elements 338 within chamber 356 and includes orifices 316 adjacent corresponding resistive elements 338. Thin film layers 352 include a slot 328 opening into chamber 356. Thin film layers 352 and orifice layer 354 attach to the media-facing side 318 of silicon substrate 350. While not illustrated in FIGS. 19–21, printhead 314 can include a TAB circuit or cable 17 such as shown in FIG. 1 for printhead 14 to couple ink-ejecting elements of thin film layer 354 with external control circuitry (not shown). Together, printhead 314 and TAB circuit 17 provide a TAB-head assembly.

A hard mask layer 360, e.g., such as a field oxide (Fox) is thermally grown on side 319 of substrate 350. A photo-imagable photo resist (not shown) is applied to hard mask layer 360 and exposed. Following development and etching, a feed trench pattern 365 results. In FIG. 20, substrate layer 350 is anisotropically etched using a wet etch such as TMAH or KOH or a dry etch such as the Bosch process to form feed trench 365 through substrate 350. The wet etch substantially self-terminates, i.e., substantially slows, at the thin film layers 352 thereby opening substrate 350 from side 319 through side 318 in communication with chamber 356 of orifice layer 354.

In FIG. 21, an adhesion layer 368 such as IJ5000 manufactured by Du Pont (E. I. Du Pont De Nemours And Company Corporation) is laminated to layer 360 and exposed through a negative mask to polymerize the layer. A protective sheet is removed and the exposed adhesion layer 368 is subjected to a chemical wash using a developer solvent, removing the unexposed areas of the adhesive layer.

Continuing in FIG. 21, a polymer filter membrane 334 is applied to adhesion layer 368. Polymer membrane 334 may be processed or manufactured separately and provided in roll form with a desired filter or hole pattern formed therein by, for example, laser ablation or chemical etching. Among a variety of materials considered usable for membrane 334, a polyimide such as Kapton (trademark registered to E. I. Du Pont De Nemours And Company Corporation) 632 is considered suitable. Membrane 334 is thereby laminated to the assembly of printhead 314 and upon contact with ink containment system 20, for example, receives ink therefrom. Membrane 334 serves a filtering function whereby the ink passing therethrough and entering trench 365 is suitably filtered and thereafter enters, by way of slot 328 in thin film layers 352, chamber 356. Suitably firing resistive elements 338 selectively ejects ink droplets from corresponding orifices 316.

Figure 22:
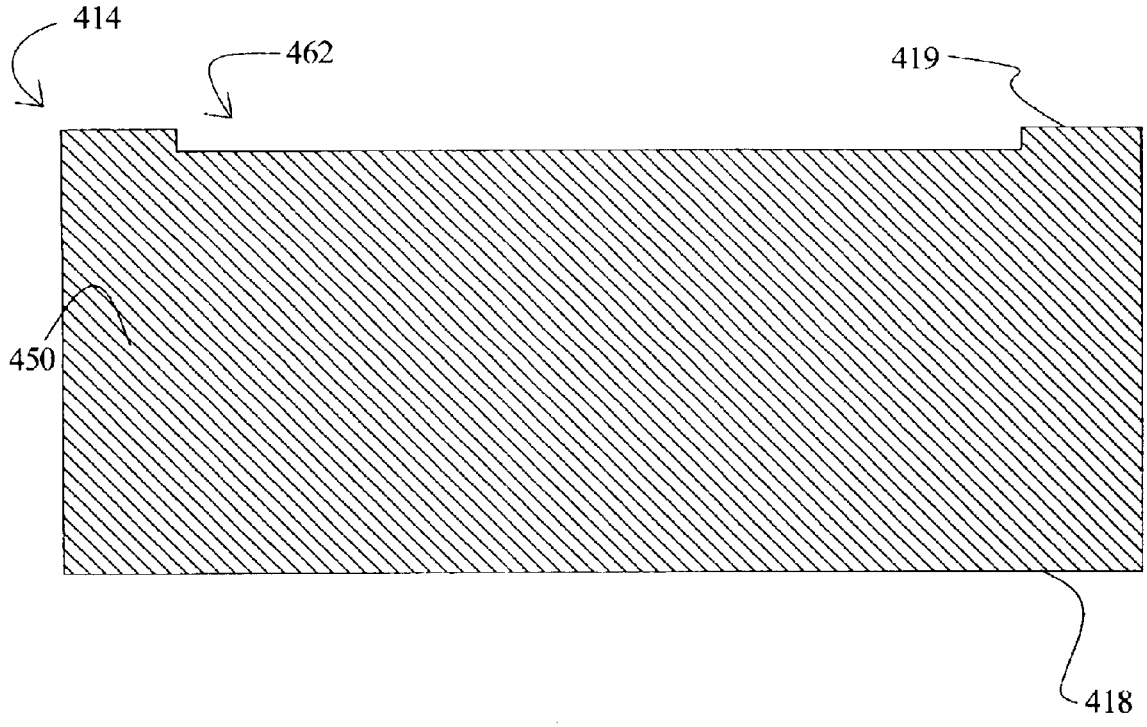
FIGS. 22–25 illustrate through a series of manufacturing steps another alternative printhead according to an embodiment of the present.
Figure 23:
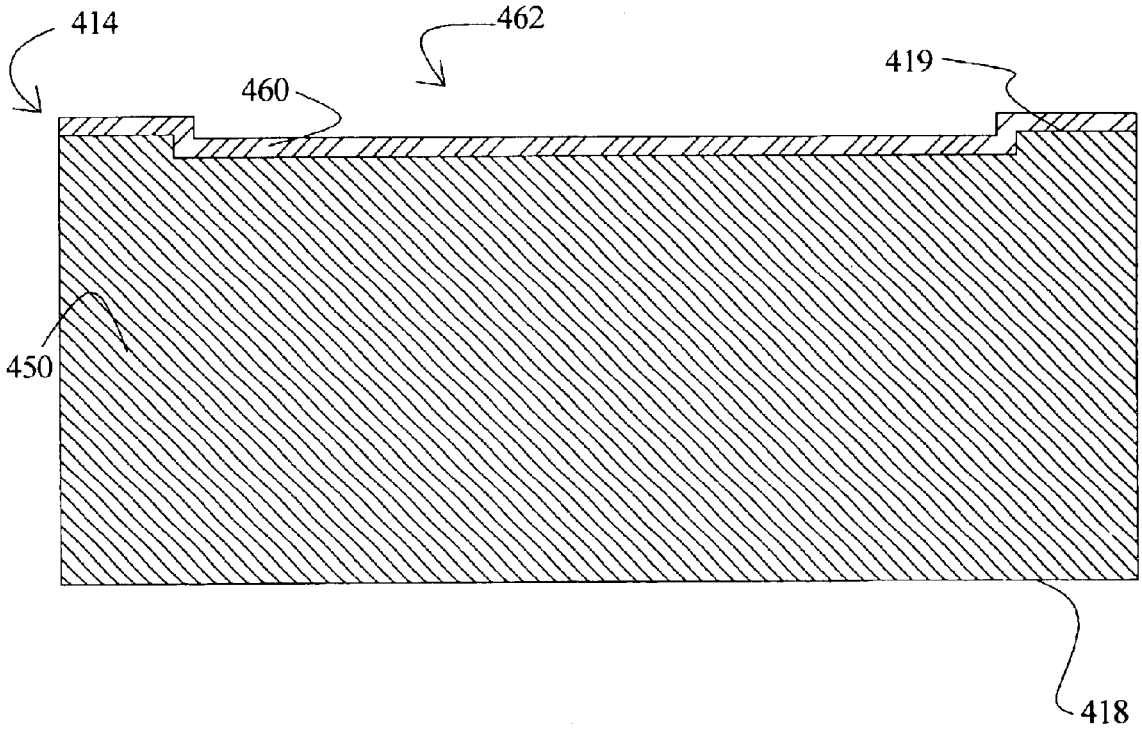

FIGS. 22–25 illustrate through a series of manufacturing steps a recessed silicon-defined printhead including integral filter element. In FIG. 22, printhead 414 begins as a silicon substrate 450. As may be appreciated, substrate 450 serves as structural support for layers 452 and 454, and as described more fully hereafter, serves as an integrated filter membrane. Printhead 414 is thereby an integrated printhead in that its filtration, fluid feed, and fluid ejecting elements are formed relative to a common silicon substrate. A recess 462 is formed in substrate 450 by wet or dry etch process in surface 419 of substrate 450. Continuing in FIG. 23, a dielectric layer 460 is grown or deposited onto surface 419 of substrate 450 including deposition or growth through recess 462.

Figure 24:
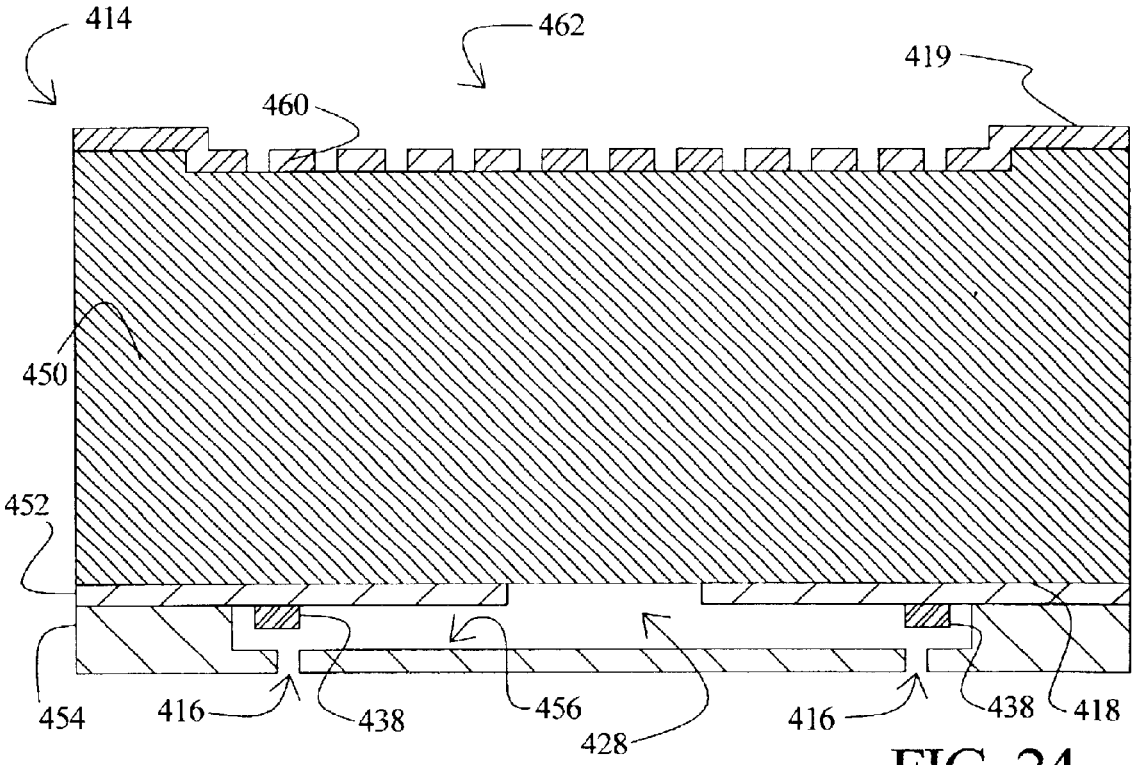

In FIG. 24, a thin film layer 452 and orifice layer 454 are attached to surface 418 of substrate 450. Dielectric layer 460 is then etched, e.g., by dry etch, at surface 419 to establish a filter hole pattern 432 in dielectric layer 460. While not illustrated in FIGS. 22–25, printhead 414 can include a TAB circuit or cable 17 such as shown in FIG. 1 for printhead 14 to couple ink-ejecting elements of thin film layer 454 with external control circuitry (not shown). Together, printhead 414 and TAB circuit 17 provide a TAB-head assembly.

Figure 25:
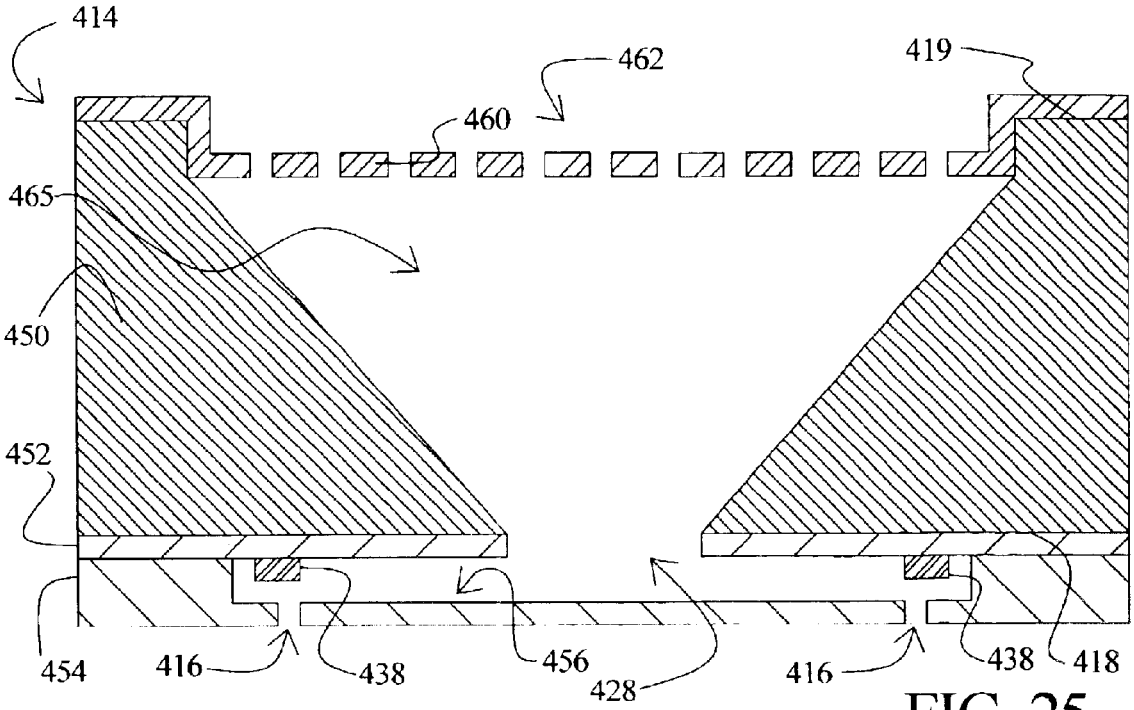

Continuing to FIG. 25, an anisotropic wet etch step applied to layer 460 through openings in pattern 462 creates the desired filter openings in layer 460 and a feed channel 465 fluidly communicating with slot 428 of thin film layer 452. Applying an ink containment system, e.g., system 20, in contact against the filter membrane 434 as provided by the etched layer 460, allows ink to pass therethrough and, in filtered form, along feed channel 465 through slot 428 and into chamber 456 of orifice layer 454. Ink ejecting elements, e.g., resistive elements 438, within chamber 456 when activated eject ink from chamber 456 and out orifices 416 as described herein above. The resulting structure protects the filter membrane 434 by its recessed position. Incorporating a shoulder structure around the filter membranes of earlier-described embodiments can be use for similar protection thereof.

Figure 26:
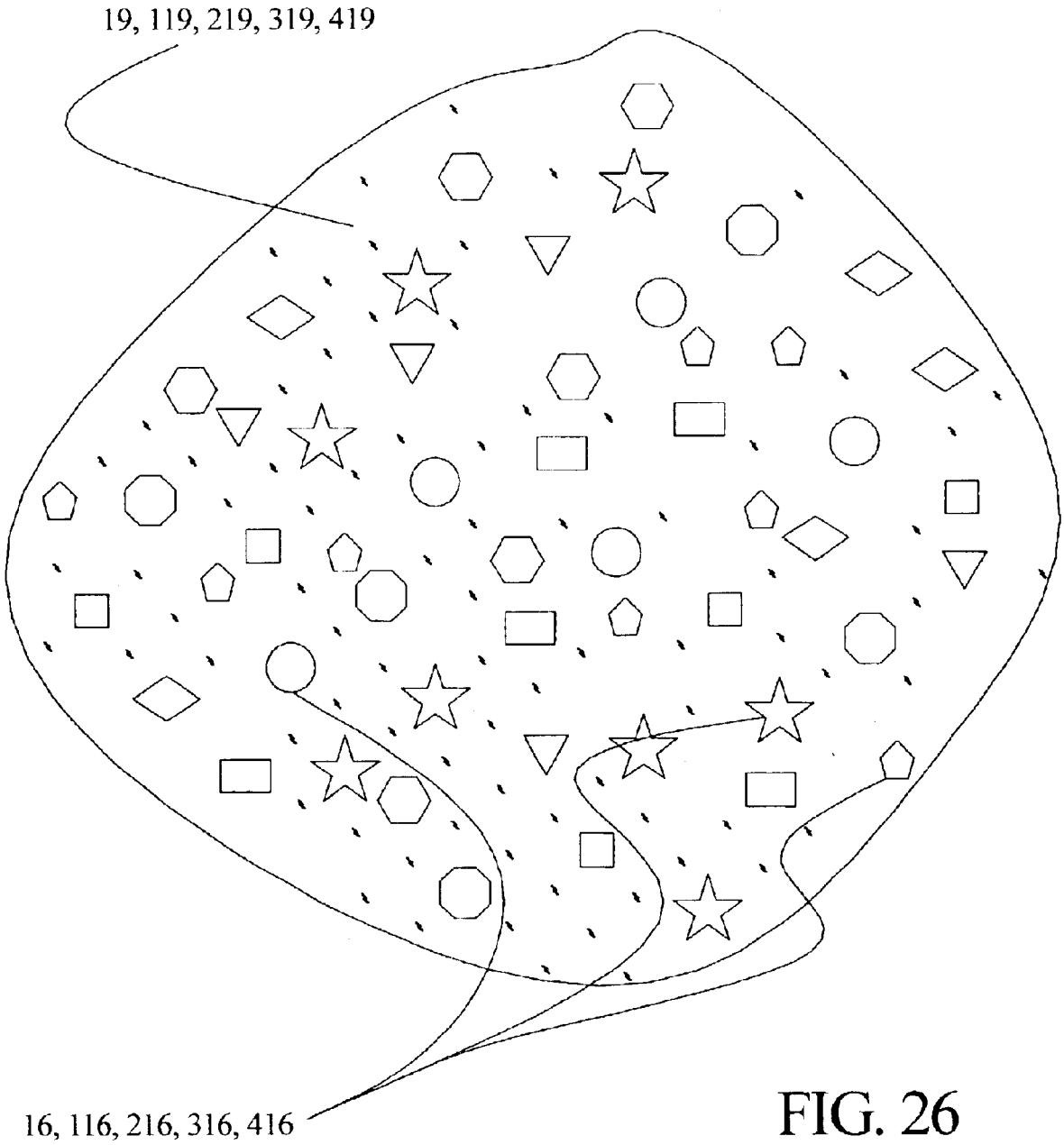
FIG. 26 illustrates variation in filter hole pattern density across a filter membrane according to embodiments of the present invention.

FIG. 26 illustrates hole pitch or spacing variation in a filter membrane hole pattern, e.g., patterns 132, 232, 332, and 432, across the filter membrane to improve the strength thereof without affecting a desired or target ink flow rate. More particularly, FIG. 26 illustrates partially an etched silicon filter membrane, e.g., one of membranes 134, 234, 334, or 434, as viewed looking into the backside or ink containment-facing side, e.g., sides 19, 119, 219,319, or 419, of a silicon substrate. By increasing filter hole spacing or pitch, e.g., near the edges of the filter membrane, greater strength results where greater strength finds advantage. As illustrated in FIG. 26, it will be understood that filter hole cross-sections as proposed under various embodiments of the present invention may vary as permitted under available manufacturing, e.g., silicon etching, processes. Thus, for example, the cross section of the filter apertures can have a number of different shapes and sizes either uniformly, such as one shape throughout, or in combination, such as various shape and sizes throughout, as substrate etching processes allow. FIG. 26, for example, illustrates a plurality of fluid filter holes distributed across the surface of a filter under various embodiments of the present invention including holes of a cross-sectional shape taken from a group of shapes including substantially round, oval, star, square, rectangular, triangular, and polygonal.

Printheads 14, 114, 214, 314, and 414 as illustrated herein may be employed in a variety of print cartridge architectures. As applied in the particular print cartridge 10 described above, printheads 14, 114, 214, 314, and 414 may be applied directly to ink containment system 20. More particularly, the filter membrane surface, e.g., that surface presenting a pattern of holes serving a filtration function along an ink flow direction, can contact directly an access surface of the ink containment element and, therefore, contact a body of ink held therein to establish a filtration function at the access surface of the ink containment element. Overall, a significantly smaller, i.e., thinner, printhead results and finds particularly useful application as a micro-printhead where reduced size and weight find advantage.

Print cartridge filters and methods of manufacture as illustrated herein allow a high degree of design flexibility not available in existing print cartridge designs and method of manufacture. For example, the filter membrane as illustrated herein can be embedded in the printhead substrate surface or formed in a recess in the substrate surface to protect the filter membrane from damage during handling and assembly. The hydraulic diameter of such apertures can be increased to increase ink flow without undesirably allowing therepast larger sized particulates.

Figure 27:
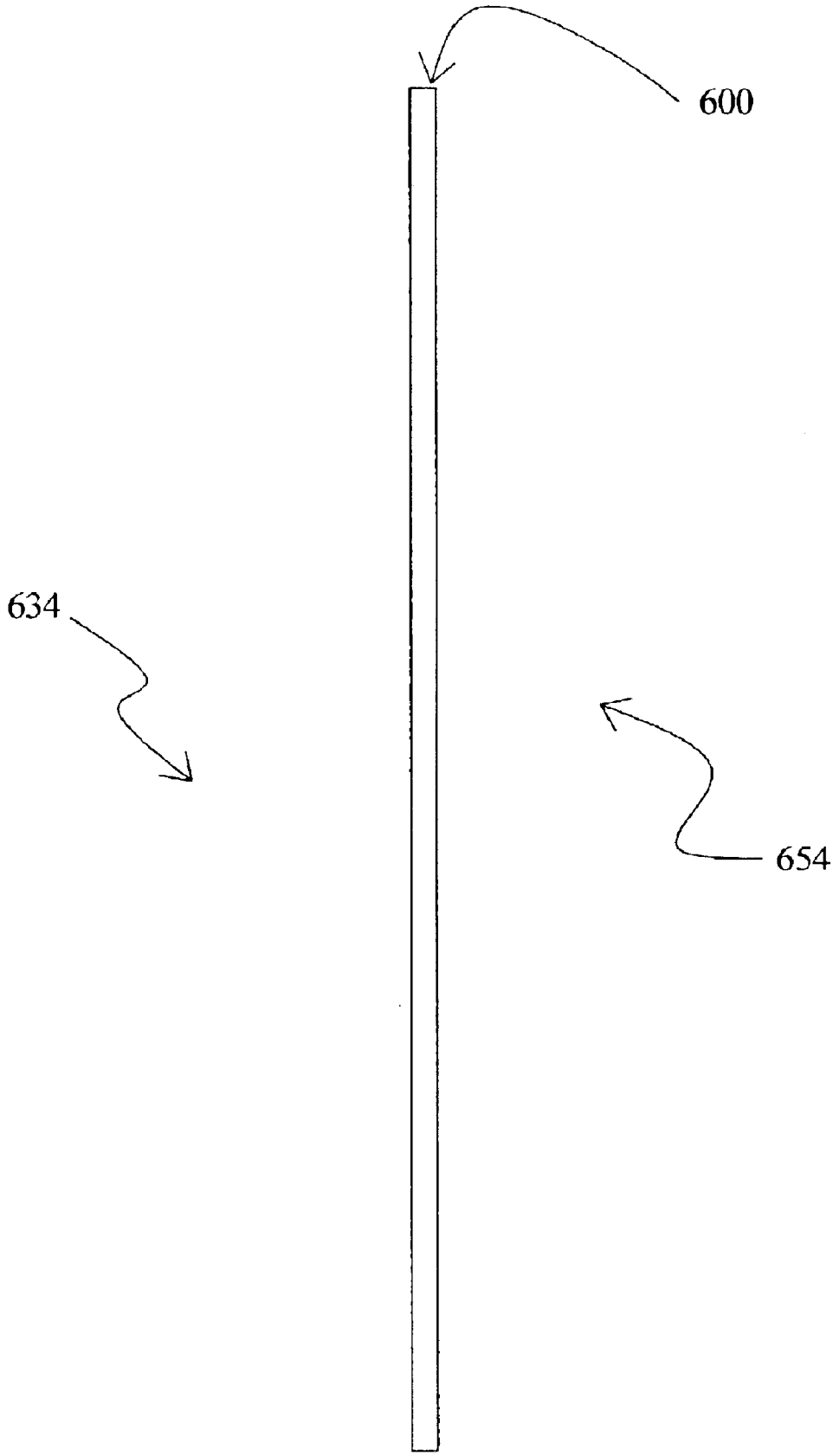
FIG. 27 illustrates a silicon wafer following manufacture and including a plurality of integrated printhead and filter devices according to embodiments of the present invention and distributed throughout the wafer.

It will be further appreciated that an integrated printhead finds advantage in its integral production at a wafer level as opposed to distinct assembly at a pen or cartridge construction level. Integrated production at the wafer level allows formation of integrated printhead and filter assemblies in mass, e.g., as many as can fit on a given wafer. FIG. 27 illustrates a silicon wafer 600 following manufacture and including a plurality integrated printhead and filter devices according to various embodiments of the present invention and distributed throughout wafer 600. Viewing wafer 600 along an edge-view as in FIG. 27, a plurality of orifice layers 654 reside on one side of wafer 600 and a corresponding plurality of filter membranes 634 lie with filter surfaces exposed on the opposite side of wafer 600. Exposed filter surfaces in an integrated printhead are well adapted for contacting the access surface of fluid containment elements when incorporated into a print cartridge as described herein. Thus, an inventory of integrated printhead and filter devices, can be produced in mass on a given silicon wafer. When cut from the wafer and applied to subsequent cartridge assembly, integrated printhead and filter devices as disclosed under various embodiments herein make more efficient overall cartridge assembly as well as improved device performance and expanded applications, e.g., as micro-printheads. Stacking separately and previously manufactured filter elements at the time of pen or cartridge assembly, as found in prior methods of cartridge manufacture, involves individual filter component handling and additional assembly steps not involved under embodiments of the present invention.

Overall, manufacturing or assembly according to embodiments of the present invention as illustrated herein is simplified and made more reliable. Traditional printhead cartridge manufacturing with traditional filters includes significant process steps with respect to flushing the standpipes to remove particles and contaminates present in the cartridge during manufacture; picking and placing filter elements in the print cartridge body; separately attaching the distinct filter element such as by heat stake or mechanical attachment; inserting foam or fiber material into the printhead body; placing and ultrasonically welding a lid to the print cartridge body; attaching a TAB-head-assembly or ribbon cable to the print cartridge body with structural adhesive; heat staking the TAB-circuit to the print cartridge body; filling the cartridge with ink and sealing the fill port; and priming the print cartridge.

Figure 28:
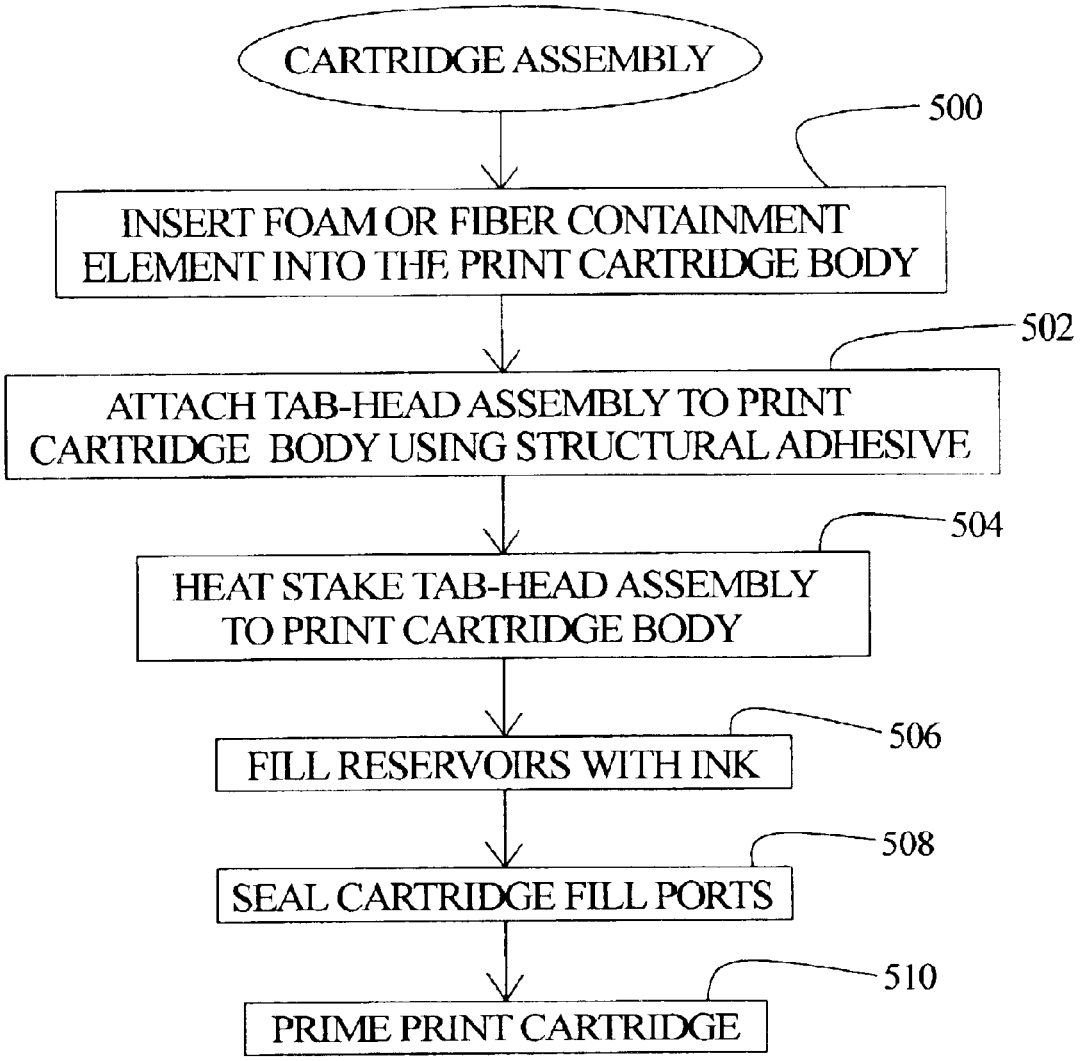
FIG. 28 illustrates by flow chart a method of print cartridge manufacture under embodiments of the present invention.

Under embodiments of the present invention, however, manufacturing is simplified as illustrated in FIG. 28. In FIG. 28, a printhead cartridge may be produced according to embodiments of the present invention by inserting (step 500) foam or fiber material into the print cartridge body, e.g., containment system 20 into reservoir 12; attaching (step 502) a TAB-head assembly to the print cartridge body with structural adhesive, e.g., one of printheads 14, 114, 214, 314, or 414 with suitable TAB or conductive ribbon attached thereto as a TAB-head assembly; heat staking (Step 504) the TAB-head assembly to the print cartridge body; filling (step 506) reservoirs 12 with ink; sealing (step 508) the fill ports; and priming (step 508) the print cartridge.

Comparing the manufacturing process available under embodiments of the present invention with that of traditional processes, one observes that integrally incorporating the filter in the printhead simplifies print cartridge manufacturing. Since the filter is no longer upstream of a standpipe, or air accumulation region, cleaning procedures maybe relaxed. In addition, a distinct filter placement and attachment operation is not involved since the filter is integral to the printhead. Also, a separate lid is not needed to place and weld when closing the cartridge body since this function is now performed by the TAB-head assembly, e.g., by one of printheads 14, 114, 214, 314, or 414 with suitable TAB or conductive ribbon attached thereto as a TAB-head assembly.

While multi-color cartridge embodiments of the present invention have been shown, it will be understood that further embodiments of the present invention include single color cartridges having one ink supply.

While the present invention has been particularly shown and described with reference to the foregoing preferred and alternative embodiments, those skilled in the art will understand that many variations may be made therein without departing from the scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. An integrated fluid ejection device comprising:

a fluid ejection element;

a fluid filter, said filter varying in thickness; and a feed trench between said filter and said fluid ejection element wherein said fluid ejection element, said fluid filter, and said feed trench are formed relative to a single substrate.

2. A device according to claim 1 wherein the fluid ejection element comprises an inkjet printhead.

3. A device according to claim 2 wherein the inkjet printhead is a thermal inkjet printhead.

4. A device according to claim 1 wherein said substrate comprises a silicon substrate.

5. A device according to claim 4 wherein said fluid filter comprises at least one hole formed by an etching process.

6. A device according to claim 4 where said fluid filter comprises a plurality of holes distributed across a surface of said filter, said plurality of holes varying in spacing therebetween.

7. A device according to claim 4 where said fluid filter comprises a plurality of holes distributed across a surface of said filter, said plurality of holes including at least one hole presenting a cross-section of shape taken from a group of shapes including substantially round, oval, star, square, rectangular, triangular, and polygonal.

8. A print cartridge comprising:

a fluid containment element presenting an access surface; and an integrated printhead including a first and second surface, said first surface including a set of fluid-ejecting orifices, said second surface comprising an integral filter contacting said access surface, said filter varying in thickness.

9. A cartridge according to claim 8 wherein a relatively thinner portion of said filter establishes an air accumulation structure.

10. A cartridge according to claim 9 wherein a non-planar surface of said filter establishes said air accumulation structure.

11. An integrated inkjet printhead and filter comprising:

a photo-imaged filter portion having a varying thickness, a first side of said filter portion including an exposed surface, a second side of said filter portion including a feed trench;

a circuit portion, a first side of said circuit portion being integrally coupled to said second side of said filter portion, a second side of said circuit portion including at least one ink ejecting element, a slot formation through said circuit portion being fluidly coupled to said feed french; and an orifice portion, a first side of said orifice portion being integrally coupled to said second side of said circuit portion and defining at least in part a chamber, said chamber being fluidly coupled to said slot and holding said at least one ink ejecting element.

12. An integrated inkjet printhead and filter according to claim 11 wherein said filter portion includes an air accumulation structure downstream from said exposed surface along a direction from said filter portion toward said orifice portion.

13. An integrated inkjet printhead and filter according to claim 11 wherein said exposed surface captures particulates of given size as a function of filter holes provided in said exposed surface.

14. An integrated inkjet printhead and filter according to claim 11 wherein said filter portion comprises a silicon substrate.

15. An integrated inkjet printhead and filter according to claim 14 wherein said silicon substrate structurally and integrally supports said circuit portion and said orifice portion.

16. An integrated inkjet printhead and filter according to claim 14 wherein said exposed surface comprises etched filter hole formations.

17. An integrated inkjet printhead and filter according to claim 14 wherein said exposed surface comprises photo etched filter hole formations.

18. An integrated inkjet printhead and filter according to claim 11 wherein said filter portion and said orifice portion comprise silicon.

19. An integrated inkjet printhead and filter according to claim 11 further comprising a TAB circuit including at least one exposed electrical contact, said at least one exposed electrical contact being electrically coupled to said circuit portion.

20. An integrated inkjet printhead and filter according to claim 11 wherein said filter comprises a material taken from a group of materials including hard mask and polymer.

21. A method of manufacturing a print cartridge, the method comprising: providing a cartridge body including a reservoir chamber and corresponding reservoir chamber opening; inserting an ink containment element into said reservoir chamber via said chamber opening; providing an integrated printhead assembly; attaching said integrated printhead assembly to said body including face-to-face contact between a filter membrane surface of said printhead assembly and an access surface of said ink containment element; and closing said chamber opening with said printhead assembly.

22. A method of manufacturing according to claim 21 wherein said printhead assembly comprises: a fluid ejection element; a fluid filter; and a feed french between said filter and said fluid ejection element wherein said fluid ejection element, said fluid filter, and said feed trench are formed from a single substrate.

23. A method of manufacturing according to claim 21 further comprising filling said reservoir chamber with ink, sealing said reservoir chamber, and priming said cartridge.

24. A method of manufacturing according to claim 21 wherein said method comprises forming said integrated printhead assembly concurrently with a plurality of similar printhead assemblies upon a common silicon wafer.

* * * * *

UNITED STATES PATENT AND TRADEMARK OFFICE

CERTIFICATE OF CORRECTION

PATENT NO. : 6,916,090 B2
APPLICATION NO. : 10/386284
DATED : July 12, 2005
INVENTOR(S) : Jeffrey M. Valley et al.

It is certified that error appears in the above-identified patent and that said Letters Patent is hereby corrected as shown below:

In column 7, line 12, delete “14” and insert -- 114 --, therefor.

In column 9, line 47, delete “632” and insert -- 362 --, therefor.

In column 13, line 19, in Claim 11, delete “french” and insert -- trench --, therefor.

In column 14, line 29, in Claim 22, delete “french” and insert -- trench --, therefor.

Signed and Sealed this

Fourth Day of August, 2009

JOHN DOLL
*Acting Director of the United States Patent and Trademark Office*